US007083554B1

(12) United States Patent
Lo Presti

(10) Patent No.: US 7,083,554 B1
(45) Date of Patent: Aug. 1, 2006

(54) EXERCISE MACHINE WITH INFINITE POSITION RANGE LIMITER AND AUTOMATIC BELT TENSIONING SYSTEM

(75) Inventor: Michael A. Lo Presti, Galax, VA (US)

(73) Assignee: Nautilus, Inc., Vancouver, WA (US)

( * ) Notice: Subject to any disclaimer, the term of this patent is extended or adjusted under 35 U.S.C. 154(b) by 0 days.

(21) Appl. No.: 08/807,372

(22) Filed: Feb. 27, 1997

(51) Int. Cl.
*A63B 21/00* (2006.01)
*A63B 21/062* (2006.01)
*A63B 26/00* (2006.01)

(52) U.S. Cl. ..... 482/137; 482/100; 482/142

(58) Field of Classification Search ..... 482/93, 482/94, 98–100, 135–138, 102–103, 142
See application file for complete search history.

(56) References Cited

U.S. PATENT DOCUMENTS

| | | | |
|---|---|---|---|
| 37,713 | A | 2/1863 | Van Houten |
| 43,149 | A | 6/1864 | Wood |
| 108,401 | A | 10/1870 | Smith |
| 192,338 | A | 6/1877 | Marshall |
| 393,265 | A | 11/1888 | Rice |
| 457,400 | A | 8/1891 | Dowd |
| 511,251 | A | 12/1893 | Pickles |
| 551,803 | A | 12/1895 | Whitely |
| 580,420 | A | 4/1897 | Nickerson |
| 595,492 | A | 12/1897 | McFadden |
| 629,655 | A | 7/1899 | Bryon, Jr. |
| 664,210 | A | 12/1900 | Bryon, Jr. |
| 684,688 | A | 10/1901 | Herz |
| 685,788 | A | 11/1901 | McFadden |
| 691,538 | A | 1/1902 | Frigerio |

(Continued)

FOREIGN PATENT DOCUMENTS

CA 1 183 882 3/1985

(Continued)

OTHER PUBLICATIONS

"8300s Series II Strength System," Schwinn Cycling & Fitness Inc., one page of product brochure showing 8300 Series II Strength System, 1 page (1999).

(Continued)

*Primary Examiner*—Gregory L. Huson
*Assistant Examiner*—Fenn C. Mathew
(74) *Attorney, Agent, or Firm*—Dorsey & Whitney LLP

(57) ABSTRACT

An exercise machine having infinite range limiting capability comprises: a frame; a pivotable exercise arm mounted to the frame configured to engage an exercising user and moveable along a stroke path having a fully extended position and a fully flexed position; a movement-resisting system for resisting movement of the exercise arm along the stroke path; an interconnecting unit for interconnecting the exercise arm and the movement-resisting unit so that movement of the exercise arm causes a portion of the movement-resisting unit to move in response thereto; and a range-limiting unit for limiting the distance the exercise arm moves along the stroke path during exercise. The range-limiting unit is connected to the interconnecting unit and is configured to enable a user of the exercise machine to select a first partially flexed position at any desired location along the stroke path such that the exercise arm moves between the first partially flexed position and the fully extended position serving during exercise. The range limiting unit is also configured so that movement of the exercise arm away from the fully extended position past the first partially flexed position by the user selects a second partially flexed position such that the exercise arm moves between the second partially flexed position and the fully extended position during exercise.

21 Claims, 8 Drawing Sheets

U.S. PATENT DOCUMENTS

| | | | |
|---|---|---|---|
| 716,520 | A | 12/1902 | Cole |
| 763,475 | A | 6/1904 | Frazee et al. |
| 772,906 | A | 10/1904 | Reach |
| 776,824 | A | 12/1904 | Byron, Jr. |
| 799,270 | A | 9/1905 | Roland |
| 848,272 | A | 3/1907 | Thornley |
| 885,074 | A | 4/1908 | Nidever |
| 1,053,109 | A | 2/1913 | Reach |
| 1,205,426 | A | 11/1916 | Bamhill |
| 1,371,750 | A | 3/1921 | Fox |
| 1,547,268 | A | 7/1925 | Sotomayor |
| 1,585,748 | A | 5/1926 | Wendelken |
| 1,646,818 | A | 10/1927 | Holland |
| 1,703,104 | A | 2/1929 | Hassler |
| 1,707,791 | A | 4/1929 | Anderson |
| 1,745,435 | A | 2/1930 | Mensendieck |
| 1,867,642 | A | 7/1932 | Woods |
| 1,928,089 | A | 9/1933 | Blickman |
| 2,131,570 | A | 9/1938 | Riley |
| 2,223,309 | A | 11/1940 | Swanson |
| 2,436,987 | A | 9/1948 | Bailleaux |
| 2,632,645 | A | 3/1953 | Barkschat |
| 2,753,722 | A | 7/1956 | De Grave |
| 2,788,211 | A | 4/1957 | Ivanoff |
| 2,855,199 | A | 10/1958 | Noland et al. |
| 2,921,791 | A | 1/1960 | Berne |
| 2,944,592 | A | 7/1960 | Halter |
| 2,977,120 | A | 3/1961 | Morris |
| 3,306,611 | A | 2/1967 | Gaul |
| 3,309,084 | A | 3/1967 | Simmons |
| 3,323,366 | A | 6/1967 | DeLorme, Jr. et al. |
| 3,342,485 | A | 9/1967 | Gaul |
| 3,379,439 | A | 4/1968 | Sorenson et al. |
| 3,394,934 | A | 7/1968 | Elia et al. |
| 3,550,523 | A | 12/1970 | Segal |
| 3,567,219 | A | 3/1971 | Foster |
| 3,575,058 | A | 4/1971 | Kraus |
| 3,588,101 | A | 6/1971 | Jungreis |
| 3,589,715 | A | 6/1971 | Mark et al. |
| 3,596,907 | A | 8/1971 | Brighton et al. |
| 3,598,404 | A | 8/1971 | Bowman |
| 3,614,097 | A | 10/1971 | Blickman |
| 3,638,941 | A | 2/1972 | Kulkens |
| 3,647,209 | A | 3/1972 | La Lanne |
| 3,658,327 | A | 4/1972 | Thiede |
| 3,662,602 | A | 5/1972 | Weiss |
| 3,701,529 | A | 10/1972 | Kruthaupt |
| 3,707,285 | A | 12/1972 | Martin |
| 3,708,167 | A | 1/1973 | Potgieter |
| 3,712,613 | A | 1/1973 | Feather et al. |
| 3,734,495 | A | 5/1973 | Nist et al. |
| 3,752,473 | A | 8/1973 | La Lanne |
| 3,759,512 | A | 9/1973 | Yount et al. |
| 3,792,860 | A | 2/1974 | Selnes |
| 3,822,599 | A | 7/1974 | Brentham |
| 3,848,467 | A | 11/1974 | Flavell |
| 3,848,870 | A | 11/1974 | Craig |
| 3,850,431 | A | 11/1974 | Winans |
| 3,856,297 | A | 12/1974 | Schnell |
| 3,858,873 | A | 1/1975 | Jones |
| 3,912,261 | A | 10/1975 | Lambert, Sr. |
| 3,970,302 | A | 7/1976 | McFee |
| 3,981,500 | A | 9/1976 | Ryan |
| 3,998,454 | A | 12/1976 | Jones |
| 4,063,727 | A | 12/1977 | Hall |
| 4,066,259 | A | 1/1978 | Brentham |
| 4,082,267 | A | 4/1978 | Flavell |
| 4,109,907 | A | 8/1978 | Zito |
| 4,111,414 | A | 9/1978 | Roberts |
| 4,114,610 | A | 9/1978 | Koch |
| 4,129,297 | A | 12/1978 | Dolan |
| 4,130,014 | A | 12/1978 | Eddens |
| 4,140,312 | A | 2/1979 | Buchmann |
| 4,149,713 | A | 4/1979 | McLeod |
| 4,154,441 | A | 5/1979 | Gajda |
| 4,169,591 | A | 10/1979 | Douglas |
| 4,199,139 | A | 4/1980 | Mahnke et al. |
| 4,200,279 | A | 4/1980 | Lambert, Jr. |
| 4,204,676 | A | 5/1980 | Givens |
| 4,208,049 | A | 6/1980 | Wilson |
| D256,821 | S | 9/1980 | Weider |
| 4,229,002 | A | 10/1980 | Masters |
| 4,231,568 | A | 11/1980 | Riley et al. |
| 4,235,437 | A | 11/1980 | Ruis et al. |
| 4,240,626 | A | 12/1980 | Lambert, Jr. |
| 4,240,627 | A | 12/1980 | Brentham |
| 4,247,098 | A | 1/1981 | Brentham |
| 4,253,662 | A | 3/1981 | Podolak |
| 4,254,949 | A | 3/1981 | Brentham |
| 4,257,592 | A | 3/1981 | Jones |
| 4,272,074 | A | 6/1981 | Sferle |
| 4,290,597 | A | 9/1981 | Schleffendorf |
| 4,296,924 | A | 10/1981 | Anzaldua et al. |
| D262,812 | S | 1/1982 | Lambert, Jr. et al. |
| 4,328,965 | A | 5/1982 | Hatfield |
| 4,333,644 | A | 6/1982 | Lambert, Jr. et al. |
| 4,336,934 | A | 6/1982 | Hanagan et al. |
| 4,349,192 | A | 9/1982 | Lambert, Jr. et al. |
| 4,349,193 | A | 9/1982 | Lambert, Jr. et al. |
| 4,354,675 | A | 10/1982 | Barclay et al. |
| 4,354,676 | A | 10/1982 | Ariel |
| 4,357,010 | A | 11/1982 | Telle |
| 4,357,011 | A | 11/1982 | Voris |
| RE31,113 | E | 12/1982 | Coker et al. |
| 4,363,480 | A | 12/1982 | Fisher et al. |
| RE31,170 | E | 3/1983 | Mazman |
| 4,387,893 | A | 6/1983 | Baldwin |
| 4,387,894 | A | 6/1983 | Baumann |
| 4,397,462 | A | 8/1983 | Wilmarth |
| 4,398,713 | A | 8/1983 | Ellis |
| 4,402,505 | A | 9/1983 | Young |
| 4,405,128 | A | 9/1983 | McLaughlin et al. |
| 4,407,503 | A | 10/1983 | Nishizawa |
| 4,411,421 | A | 10/1983 | Hershberger |
| 4,411,424 | A | 10/1983 | Barmett |
| 4,426,077 | A | 1/1984 | Becker |
| 4,428,578 | A | 1/1984 | Kirkpatrick |
| 4,429,871 | A | 2/1984 | Flechner |
| 4,456,245 | A | 6/1984 | Baldwin |
| 4,466,613 | A | 8/1984 | Reese |
| 4,468,025 | A | 8/1984 | Sferle |
| 4,469,325 | A | 9/1984 | Ware |
| 4,478,411 | A | 10/1984 | Baldwin |
| 4,478,413 | A | 10/1984 | Siwula |
| 4,493,485 | A | 1/1985 | Jones |
| 4,494,662 | A | 1/1985 | Clymer |
| 4,500,089 | A | 2/1985 | Jones |
| 4,502,681 | A | 3/1985 | Blomqvist |
| 4,505,475 | A | 3/1985 | Olschansky et al. |
| 4,511,137 | A | 4/1985 | Jones |
| 4,512,571 | A | 4/1985 | Hermelin |
| 4,515,363 | A | 5/1985 | Schleffendorf |
| 4,535,985 | A | 8/1985 | Mask |
| 4,536,027 | A | 8/1985 | Brennan |
| 4,540,171 | A | 9/1985 | Clark et al. |
| 4,542,899 | A | 9/1985 | Hendricks |
| 4,546,971 | A | 10/1985 | Raasoch |
| 4,549,733 | A | 10/1985 | Salyer |
| 4,555,109 | A | 11/1985 | Hartmann |
| 4,563,000 | A | 1/1986 | Gall |
| 4,568,078 | A | 2/1986 | Weiss |
| 4,589,656 | A | 5/1986 | Baldwin |
| D284,597 | S | 7/1986 | Smith et al. |
| 4,598,908 | A | 7/1986 | Morgan |

4,600,196 A 7/1986 Jones
4,601,466 A 7/1986 Lais
4,602,373 A 7/1986 Dorfman
4,603,855 A 8/1986 Sebelle
4,605,389 A 8/1986 Westhoff
4,606,541 A 8/1986 Kirkpatrick
4,609,189 A 9/1986 Brasher
4,609,193 A 9/1986 Paris et al.
4,620,704 A 11/1986 Shifferaw
4,621,807 A 11/1986 Stramer
4,624,457 A 11/1986 Silberman et al.
4,627,615 A 12/1986 Nurkowski
4,629,185 A 12/1986 Amann
4,632,388 A 12/1986 Schleffendorf
4,632,390 A 12/1986 Richey
4,634,118 A 1/1987 Jensen
4,634,127 A 1/1987 Rockwell
4,635,926 A 1/1987 Minkow
4,640,508 A 2/1987 Escher
4,643,420 A 2/1987 Riley et al.
4,645,205 A 2/1987 Wolff
4,648,594 A 3/1987 Schleffendorf
4,653,750 A 3/1987 McIntyre
4,666,149 A 5/1987 Olschansky et al.
4,666,152 A 5/1987 Jones
4,684,124 A 8/1987 Escher
4,684,125 A 8/1987 Lantz
4,685,670 A 8/1987 Zinkin
4,687,197 A 8/1987 Larsson et al.
4,690,402 A 9/1987 Basting
4,697,809 A 10/1987 Rockwell
4,700,944 A 10/1987 Sterba et al. ..... 272/117
4,703,928 A 11/1987 Escher
4,708,338 A 11/1987 Potts
4,709,918 A 12/1987 Grinblat
4,709,920 A 12/1987 Schnell
4,717,145 A 1/1988 Chininis
4,721,303 A 1/1988 Fitzpatrick
4,722,522 A 2/1988 Lundgren
4,725,056 A 2/1988 Behri et al.
4,725,057 A 2/1988 Shifferaw
4,730,828 A 3/1988 Lane
4,730,829 A 3/1988 Carlson
4,732,381 A 3/1988 Skowronski
4,733,860 A 3/1988 Steffee
4,743,011 A 5/1988 Coffey
4,749,182 A 6/1988 Duggan
4,749,189 A 6/1988 Frank
4,750,736 A 6/1988 Watterson
4,753,126 A 6/1988 Sammaratano ..... 74/526
4,756,527 A 7/1988 Ledbetter
4,763,897 A 8/1988 Yakata
4,765,613 A 8/1988 Voris
4,765,614 A 8/1988 Shute
4,768,779 A 9/1988 Oehman, Jr. et al.
4,772,015 A 9/1988 Carlson et al.
4,773,398 A 9/1988 Tatom
4,781,374 A 11/1988 Ledeman
4,793,608 A 12/1988 Mahnke et al.
D299,371 S 1/1989 Tsuyama
4,795,149 A 1/1989 Pearson
4,796,881 A 1/1989 Watterson
4,799,671 A 1/1989 Hoggan et al.
4,804,179 A 2/1989 Murphy et al.
4,809,972 A 3/1989 Rasmussen et al.
4,809,973 A 3/1989 Johns
4,813,667 A 3/1989 Watterson
4,815,746 A 3/1989 Ward, Jr.
4,822,032 A * 4/1989 Whitmore et al. ..... 482/63
4,822,036 A 4/1989 Dang
4,824,104 A 4/1989 Bloch
4,826,153 A 5/1989 Schalip
4,826,157 A 5/1989 Fitzpatrick
4,834,365 A 5/1989 Jones
4,834,367 A 5/1989 Salyer et al.
4,836,536 A 6/1989 Jones
4,836,537 A 6/1989 Moreno
4,838,548 A 6/1989 Maag
4,840,373 A 6/1989 Maag
4,842,268 A 6/1989 Jenkins
4,842,271 A * 6/1989 Vinciguerra ..... 482/100
4,842,272 A 6/1989 Jennings
4,844,456 A 7/1989 Habing et al.
4,846,458 A 7/1989 Potts
4,848,740 A 7/1989 VanDerHoeven
4,848,741 A 7/1989 Heermanson
4,858,915 A 8/1989 Szabo
4,858,917 A 8/1989 Montgomery
4,861,025 A 8/1989 Rockwell
4,863,161 A 9/1989 Telle
4,863,163 A 9/1989 Wehrell
4,869,497 A 9/1989 Stewart et al.
4,872,668 A 10/1989 McGillis et al.
4,872,670 A 10/1989 Nichols
4,878,397 A 11/1989 Lennon
4,878,662 A 11/1989 Chem
4,878,663 A 11/1989 Luquette
4,883,270 A 11/1989 Maag
4,889,336 A 12/1989 Schneiderman
4,890,830 A 1/1990 Kern
D306,050 S 2/1990 Brentham
4,898,381 A 2/1990 Gordon
4,900,018 A 2/1990 Ish, III et al.
4,902,007 A 2/1990 Ferrari
4,902,009 A 2/1990 Jones
4,907,798 A 3/1990 Burchatz
4,911,435 A 3/1990 Johns
4,911,438 A 3/1990 Van Straaten
4,913,423 A 4/1990 Farran et al.
D307,782 S 5/1990 Birrell et al.
4,921,242 A 5/1990 Watterson
4,930,768 A 6/1990 Lapcevic
4,940,227 A 7/1990 Coffey
4,944,511 A 7/1990 Francis
4,949,951 A 8/1990 Deol
4,961,428 A 10/1990 Nikias et al.
4,974,838 A 12/1990 Sollenberger
4,979,737 A 12/1990 Kock
4,982,955 A 1/1991 Heasley
4,986,538 A 1/1991 Ish, II
4,988,095 A 1/1991 Ferrari
4,993,666 A 2/1991 Baymak et al.
5,000,446 A 3/1991 Sarno
5,002,271 A 3/1991 Gonzales
5,005,831 A 4/1991 Hara
5,011,139 A 4/1991 Towley
D317,032 S 5/1991 Eckler
5,013,031 A 5/1991 Bull
5,018,725 A 5/1991 Cook
5,020,794 A 6/1991 Englehardt et al.
D317,959 S 7/1991 Francis
5,029,850 A 7/1991 van Straaten
5,037,089 A 8/1991 Spagnuolo et al.
5,039,089 A 8/1991 Lapcevic
5,039,091 A 8/1991 Johnson
5,042,798 A 8/1991 Sawicky
5,042,799 A 8/1991 Stanley
5,042,801 A 8/1991 Sterba et al.
5,044,629 A 9/1991 Ryan et al.
5,044,631 A 9/1991 Jones
5,044,632 A 9/1991 Jones
5,050,873 A 9/1991 Jones
D321,025 S 10/1991 Jones
D321,026 S 10/1991 Jones
D321,027 S 10/1991 Jones
D321,028 S 10/1991 Jones 5,056,779 A * 10/1991 Webb ..... 482/137
5,060,938 A 10/1991 Hawley, Jr.
5,060,939 A 10/1991 Oswald et al.
D321,387 S 11/1991 Jones
D321,389 S 11/1991 Jones
D321,390 S 11/1991 Jones
D321,391 S 11/1991 Jones
5,062,632 A 11/1991 Dalebout et al.
5,062,633 A 11/1991 Engel et al.
5,064,191 A 11/1991 Johnson
5,066,003 A 11/1991 Jones
5,066,004 A 11/1991 Jones
5,069,447 A 12/1991 Snyderman et al.
5,076,576 A 12/1991 Johnston
5,076,577 A 12/1991 Houston
5,076,578 A 12/1991 Askonen
5,076,579 A 12/1991 Rickey
5,080,349 A 1/1992 Vittone
5,080,351 A 1/1992 Rockwell
5,085,430 A 2/1992 Habing
5,089,960 A 2/1992 Sweeney, Jr.
5,090,694 A 2/1992 Pauls et al.
D324,710 S 3/1992 Haing
5,094,124 A 3/1992 Stonehouse
5,094,449 A 3/1992 Stearns
5,094,450 A 3/1992 Stearns
5,100,131 A 3/1992 Fong
5,102,121 A 4/1992 Solow ..... 482/94
5,102,122 A 4/1992 Piane, Jr. et al.
5,104,121 A 4/1992 Webb ..... 482/137
5,106,080 A 4/1992 Jones
5,106,081 A 4/1992 Webb
5,106,083 A 4/1992 Hall
5,108,095 A 4/1992 Nichols
5,116,297 A 5/1992 Stonecipher
5,120,289 A 6/1992 Yu
5,122,106 A 6/1992 Atwood et al. ..... 482/131
5,123,886 A 6/1992 Cook
5,125,881 A 6/1992 Jones
5,125,882 A 6/1992 La Mothe et al.
D328,320 S 7/1992 Hliang
5,135,216 A 8/1992 Bingham et al.
5,135,449 A 8/1992 Jones
5,135,453 A 8/1992 Sollenberger
5,135,456 A 8/1992 Jones
5,135,458 A 8/1992 Huang
5,135,459 A 8/1992 Perry, Jr.
5,139,469 A 8/1992 Hennessey et al.
5,145,479 A 9/1992 Olschansky et al.
5,147,259 A 9/1992 Hutchins
5,147,265 A 9/1992 Pauls et al.
5,171,198 A 12/1992 Jones
5,180,354 A 1/1993 Jones
5,181,896 A 1/1993 Jones
D334,042 S 3/1993 Wang
5,190,513 A 3/1993 Habing et al.
5,195,937 A * 3/1993 Engel et al. ..... 482/119
RE34,212 E 4/1993 Potts
5,199,935 A 4/1993 Gibson et al.
5,203,755 A 4/1993 Kaiser
5,205,802 A 4/1993 Swisher
5,205,804 A 4/1993 Hall
D335,511 S 5/1993 Engel et al.
5,209,461 A 5/1993 Whightsel, Sr.
5,211,614 A 5/1993 Henes
D336,498 S 6/1993 Engel et al.
5,217,422 A 6/1993 Domzalski
5,217,487 A 6/1993 Engel et al.
5,221,244 A 6/1993 Doss
5,221,245 A 6/1993 Yeh
D337,361 S 7/1993 Engel et al.
D337,666 S 7/1993 Peterson et al.
5,226,867 A 7/1993 Beal
5,230,680 A 7/1993 Wu ..... 482/97
5,236,406 A 8/1993 Webber ..... 482/100
5,242,344 A 9/1993 Hundley
5,242,347 A 9/1993 Keeton
5,244,444 A 9/1993 Wostry
5,244,446 A 9/1993 Engel et al.
5,256,126 A 10/1993 Grotrstein
D341,176 S 11/1993 Habing et al.
5,263,914 A 11/1993 Simonson et al. ..... 482/99
5,263,915 A 11/1993 Habing ..... 482/99
5,265,589 A 11/1993 Wang
5,267,930 A 12/1993 Henes
5,273,504 A 12/1993 Jones
5,273,505 A 12/1993 Jones
5,273,509 A 12/1993 Vittone
5,277,681 A 1/1994 Holt
5,282,776 A 2/1994 Dalebout
RE34,572 E 3/1994 Johnson et al.
5,290,214 A 3/1994 Chen
5,295,931 A 3/1994 Dreibelbis et al.
RE34,577 E 4/1994 Habing et al.
5,299,992 A 4/1994 Wilkinson
5,300,003 A 4/1994 Hull
5,302,161 A 4/1994 Loubert et al.
5,304,107 A 4/1994 Jones
5,306,221 A 4/1994 Itaru
D347,040 S 5/1994 Wang
D347,251 S 5/1994 Dreibelbis et al.
5,308,303 A 5/1994 Rawls et al.
5,308,304 A 5/1994 Habing
5,310,392 A 5/1994 Lo
5,312,313 A 5/1994 Holmes et al.
5,312,315 A 5/1994 Moretensen et al.
5,316,528 A 5/1994 Ziparo
5,316,534 A 5/1994 Dalebout et al.
5,320,592 A 6/1994 Olschansky et al.
5,322,489 A 6/1994 Webb et al.
5,324,246 A 6/1994 Wang
5,324,247 A 6/1994 Lipley
5,328,428 A 7/1994 Huang
5,330,405 A 7/1994 Habing et al.
5,330,408 A 7/1994 Westmoreland, Jr.
5,334,113 A 8/1994 Roepke
5,336,140 A 8/1994 LeBlond
5,336,148 A 8/1994 Ish, III
5,342,270 A 8/1994 Jones
5,344,374 A 9/1994 Telle
5,346,447 A 9/1994 Stearns
5,348,524 A 9/1994 Grant
5,354,248 A 10/1994 Rawls et al.
5,354,252 A 10/1994 Habing
5,356,360 A 10/1994 Johns ..... 482/99
5,362,290 A 11/1994 Huang ..... 482/100
5,366,426 A 11/1994 Glavin
5,366,432 A 11/1994 Habing et al.
D353,423 S 12/1994 Chen
5,374,229 A 12/1994 Sencil
5,378,216 A 1/1995 Ish, III et al. ..... 482/94
5,380,258 A 1/1995 Hawley, Jr.
5,382,212 A 1/1995 Davenport et al.
D355,684 S 2/1995 Rawls et al.
5,387,170 A 2/1995 Rawls et al.
5,395,295 A 3/1995 Ish, III
5,399,133 A 3/1995 Haber et al.
5,403,257 A 4/1995 Lehtonen
5,409,435 A 4/1995 Daniels
RE34,959 E 5/1995 Potts
D358,183 S 5/1995 Habing et al.
D358,625 S 5/1995 Enriquez, Jr.
5,413,546 A 5/1995 Basile
5,417,633 A 5/1995 Habing
5,417,634 A 5/1995 Habing
D359,326 S 6/1995 Deota 5,421,796 A 6/1995 Jones et al.
5,429,569 A 7/1995 Gunnari et al.
5,431,617 A 7/1995 Rattray, Jr.
5,433,680 A 7/1995 Knudsen
5,435,798 A 7/1995 Habing et al.
5,435,799 A 7/1995 Lundin
5,437,589 A 8/1995 Habing
5,441,470 A 8/1995 Chen
D362,281 S 9/1995 Warehime et al.
5,456,644 A 10/1995 Hecox et al.
5,462,507 A 10/1995 Nichols, Sr. et al.
5,466,204 A 11/1995 Nearing
5,468,202 A 11/1995 Habing ..... 482/100
5,468,205 A 11/1995 McFall et al.
5,470,299 A 11/1995 Yeh
5,484,365 A 1/1996 Jones et al.
5,486,150 A 1/1996 Randolph
5,487,714 A 1/1996 Ferrari
5,492,386 A 2/1996 Callum
5,499,959 A 3/1996 Holmes et al.
D368,501 S 4/1996 Woodruff
5,511,740 A 4/1996 Loubert et al.
D370,040 S 5/1996 Habing et al.
5,518,477 A 5/1996 Simonson ..... 482/102
D370,949 S 6/1996 Furner
D371,176 S 6/1996 Furner
5,527,243 A 6/1996 Chen
5,527,245 A 6/1996 Dalebout
5,533,953 A 7/1996 Lui et al.
5,540,639 A 7/1996 Potts et al.
5,542,895 A 8/1996 Colbo, Jr.
5,549,530 A 8/1996 Fulks
5,549,533 A 8/1996 Olson et al.
5,554,084 A 9/1996 Jones
5,554,085 A 9/1996 Dalebout
5,554,086 A 9/1996 Habing et al.
5,554,089 A 9/1996 Jones
5,554,090 A 9/1996 Jones
5,562,577 A 10/1996 Nichols, Sr. et al.
5,565,002 A 10/1996 Rawls et al.
5,580,337 A 12/1996 Habing et al.
5,580,340 A 12/1996 Yu
5,580,341 A 12/1996 Simonson
5,582,564 A 12/1996 Nichols, Sr. et al.
5,586,962 A 12/1996 Hallmark
5,588,942 A 12/1996 Dillard
5,591,105 A 1/1997 Dalebout et al.
5,597,257 A 1/1997 Habing
5,597,375 A 1/1997 Simonson
5,599,256 A 2/1997 Hughes, Jr.
5,601,518 A 2/1997 Weintraub
RE35,470 E 3/1997 Jones
5,616,107 A 4/1997 Simonson
5,616,110 A 4/1997 Nascimento
5,616,111 A 4/1997 Randolph
5,624,362 A 4/1997 Wilson
5,625,353 A 4/1997 Naidus
5,626,548 A 5/1997 Coyle
5,628,715 A 5/1997 Simonson
D380,024 S 6/1997 Novak et al.
5,637,059 A 6/1997 Dalebout
5,643,151 A * 7/1997 Naimo ..... 482/98
5,655,997 A 8/1997 Greenberg et al.
5,665,036 A 9/1997 Hsieh
5,667,464 A 9/1997 Simonson
5,669,861 A 9/1997 Toups
5,669,865 A 9/1997 Gordon
5,674,167 A 10/1997 Piaget et al.
5,681,079 A 10/1997 Robinson
5,692,997 A 12/1997 Stearns
5,709,633 A 1/1998 Sokol
5,713,823 A 2/1998 Walendzak et al.
5,716,308 A 2/1998 Lee
5,718,654 A 2/1998 Kennedy
5,722,921 A * 3/1998 Simonson ..... 482/100
5,722,922 A 3/1998 Watterson et al.
5,725,459 A 3/1998 Rexach
5,733,229 A 3/1998 Dalebout et al.
5,733,233 A 3/1998 Webber
5,738,616 A 4/1998 Robertson
5,755,645 A 5/1998 Miller et al.
5,762,584 A 6/1998 Daniels
5,769,757 A 6/1998 Fulks
5,769,766 A 6/1998 Huange
5,776,040 A 7/1998 Webb et al.
5,788,615 A 8/1998 Jones
5,800,321 A 9/1998 Webber
5,803,882 A 9/1998 Habing et al.
5,807,219 A 9/1998 Webber et al.
5,810,698 A 9/1998 Hullett et al.
5,810,701 A 9/1998 Ellis et al.
5,813,951 A 9/1998 Einsig
5,820,529 A 10/1998 Weintraub
5,827,157 A 10/1998 Lee
5,836,858 A 11/1998 Sharff
5,839,997 A 11/1998 Roth et al.
5,860,894 A 1/1999 Dalebout
5,876,313 A 3/1999 Krull
5,885,193 A 3/1999 Habing et al.
5,888,179 A 3/1999 Singhal
5,897,467 A 4/1999 Habing et al.
5,904,638 A 5/1999 Habing et al.
5,906,566 A 5/1999 Whitcomb
5,921,897 A 7/1999 Stevens
5,921,902 A 7/1999 Carpenter
5,931,767 A 8/1999 Morales
5,938,551 A 8/1999 Warner
5,944,641 A 8/1999 Habing
D413,948 S 9/1999 Dalebout
5,951,448 A 9/1999 Bolland
5,961,427 A 10/1999 Habing et al.
5,961,428 A 10/1999 Weber
5,964,684 A 10/1999 Sokol
5,967,954 A 10/1999 Habing
5,971,895 A 10/1999 Habing
5,989,165 A 11/1999 Giannelli et al.
5,993,356 A 11/1999 Houston et al.
6,004,247 A 12/1999 Webber
6,004,248 A 12/1999 Price
6,022,299 A 2/2000 Stewart
6,027,429 A 2/2000 Daniels
6,056,678 A 5/2000 Giannelli et al.
6,059,701 A * 5/2000 George et al. ..... 482/137
6,074,328 A 6/2000 Johnson
D455,803 S 7/2000 Webber
6,090,020 A 7/2000 Webber
D428,949 S 8/2000 Simonson
6,099,440 A 8/2000 Schurter et al.
6,117,055 A 9/2000 Boland
6,120,416 A 9/2000 Walker
6,120,421 A 9/2000 Kuo
D431,615 S 10/2000 Webber et al.
6,126,580 A 10/2000 Francis et al.
6,171,219 B1 1/2001 Simonson
6,186,927 B1 2/2001 Krull
6,206,812 B1 3/2001 Nizamuddin
6,217,493 B1 4/2001 Spletzer
6,220,993 B1 4/2001 Sencil
6,224,514 B1 5/2001 Price
6,238,323 B1 5/2001 Simonson
6,251,052 B1 6/2001 Simonson
6,257,997 B1 7/2001 Doble et al.
6,258,016 B1 7/2001 Kuo
6,261,022 B1 7/2001 Dalebout et al.
6,264,586 B1 7/2001 Webber
6,264,588 B1 7/2001 Ellis

| | | | |
|---|---|---|---|
| 6,387,241 | B1 | 9/2001 | Ellis |
| 6,296,594 | B1 | 10/2001 | Simonson |
| 6,296,596 | B1 | 10/2001 | Alessandri et al. |
| 6,319,178 | B1 | 11/2001 | Webber |
| 6,364,815 | B1 | 4/2002 | Lapcevic |
| 6,371,896 | B1 | 4/2002 | Kettler |
| 6,387,020 | B1 | 5/2002 | Simonson |
| 6,394,937 | B1 | 5/2002 | Voris |
| 6,402,666 | B1 | 6/2002 | Krull |
| 6,409,631 | B1 | 6/2002 | Alessandri |
| 6,422,979 | B1 | 7/2002 | Krull |
| 6,422,980 | B1 | 7/2002 | Simonson |
| 6,440,044 | B1 | 8/2002 | Francis et al. |
| 6,443,877 | B1 | 9/2002 | Hoecht et al. |
| 6,477,430 | B1 | 9/2002 | Webb et al. |
| 6,458,061 | B1 | 10/2002 | Simonson |
| 6,471,624 | B1 | 10/2002 | Voris |
| 6,482,139 | B1 | 11/2002 | Haag |
| 6,488,612 | B1 | 12/2002 | Sechrest et al. |
| 6,491,609 | B1 | 12/2002 | Webber |
| 6,491,610 | B1 | 12/2002 | Henn |
| 6,500,106 | B1 | 12/2002 | Fulks |
| 6,517,468 | B1 | 2/2003 | Lapcevic |
| 6,551,226 | B1 | 4/2003 | Webber et al. |
| 6,591,960 | B1 | 5/2003 | Webber |
| 6,575,881 | B1 | 6/2003 | Lapcevic |
| 6,579,213 | B1 | 6/2003 | Webber et al. |
| 6,585,626 | B1 | 7/2003 | McBride |
| 6,592,498 | B1 | 7/2003 | Trainor |
| 6,595,905 | B1 | 7/2003 | McBride |
| 6,605,022 | B1 | 8/2003 | Webber |
| 6,626,805 | B1 | 9/2003 | Lightbody |
| 6,652,426 | B1 | 11/2003 | Carter et al. |
| 6,652,429 | B1 | 11/2003 | Bushnell |
| 6,669,606 | B1 | 12/2003 | Krull |
| 6,669,609 | B1 | 12/2003 | Gerschefske et al. |
| 6,685,607 | B1 | 2/2004 | Olson |
| 6,689,019 | B1 | 2/2004 | Ohrt et al. |
| 6,689,023 | B1 | 2/2004 | Baumler |
| 6,712,740 | B1 | 3/2004 | Simonson |
| 6,743,158 | B1 | 6/2004 | Giannelli et al. |
| 6,746,378 | B1 | 6/2004 | Morris et al. |
| 6,746,385 | B1 | 6/2004 | Habing |
| 6,770,015 | B1 | 8/2004 | Simonson |
| 6,770,017 | B1 | 8/2004 | Leipheimer |
| 6,817,968 | B1 | 11/2004 | Galbraith et al. |
| 6,831,542 | B1 | 12/2004 | Ball et al. |
| 6,910,994 | B1 | 6/2005 | Mitchell et al. |
| 6,913,565 | B1 | 7/2005 | Mitchell et al. |
| 2002/0025890 | A1 | 2/2002 | Keiser |
| 2002/0035017 | A1 | 3/2002 | Pertegaz-Esteban |
| 2002/0077230 | A1 | 6/2002 | Lull et al. |
| 2002/0198087 | A1 | 12/2002 | Mitchell et al. |
| 2002/0198088 | A1 | 12/2002 | Vuurmans et al. |
| 2003/0017918 | A1 | 1/2003 | Webb et all |
| 2003/0022767 | A1 | 1/2003 | Webber |
| 2003/0032524 | A1 | 2/2003 | Lamar et al. |
| 2003/0032531 | A1 | 2/2003 | Simonson |
| 2003/0045406 | A1 | 3/2003 | Stone |
| 2003/0078141 | A1 | 4/2003 | Webber |
| 2003/0092540 | A1 | 5/2003 | Gillen |
| 2003/0092541 | A1 | 5/2003 | Giannelli |
| 2003/0092543 | A1 | 5/2003 | Giannelli |
| 2003/0096681 | A1 | 5/2003 | Myers et al. |
| 2003/0100413 | A1 | 5/2003 | Huang |
| 2003/0114281 | A1 | 6/2003 | Mackert et al. |
| 2003/0176261 | A1 | 9/2003 | Simonson et al. |
| 2003/0232707 | A1 | 12/2003 | Dalebout et al. |
| 2004/0002409 | A1 | 1/2004 | Webb et al. |
| 2004/0005966 | A1 | 1/2004 | Chen |
| 2004/0009856 | A1 | 1/2004 | Hammer |
| 2004/0009857 | A1 | 1/2004 | Webb et al. |
| 2004/0023760 | A1 | 2/2004 | Cockrill, Jr. et al. |
| 2004/0023762 | A1 | 2/2004 | Lull et al. |
| 2004/0063551 | A1 | 4/2004 | Lightbody |
| 2004/0082444 | A1 | 4/2004 | Golesh |
| 2004/0091307 | A1 | 5/2004 | James |
| 2004/0176223 | A1 | 9/2004 | Morris et al. |
| 2004/0209748 | A1 | 10/2004 | Haneckow |
| 2004/0229735 | A1 | 11/2004 | Morris et al. |
| 2005/0049121 | A1 | 3/2005 | Dalebout et al. |
| 2005/0049123 | A1 | 3/2005 | Dalebout et al. |
| 2005/0124470 | A1 | 6/2005 | Schopf |
| 2005/0143230 | A1 | 6/2005 | Dalebout et al. |

FOREIGN PATENT DOCUMENTS

| | | | |
|---|---|---|---|
| CA | 1 184 577 | | 3/1985 |
| CA | 1 199 946 | | 1/1986 |
| CA | 1 203 822 | | 4/1986 |
| CA | 1 256 136 | | 6/1989 |
| CH | 457 230 | | 7/1968 |
| DE | 605 957 | | 11/1934 |
| DE | 2346105 | A1 | 3/1975 |
| DE | 3 300 073 | A1 | 7/1984 |
| DE | G. 92 13 188 | | 11/1992 |
| DE | G. 94 11 573 | | 9/1994 |
| DE | 43 20 887 | C2 | 2/1997 |
| DE | 298 01 626 | | 4/1998 |
| DE | 198 01 672 | | 11/1998 |
| EP | 121902 | A1 | 10/1984 |
| EP | 177017 | A2 | 4/1986 |
| EP | 177643 | A1 | 4/1986 |
| FR | 824654 | | 2/1938 |
| FR | 1335110 | | 7/1963 |
| FR | 2612406 | A1 | 9/1988 |
| FR | 2613237 | A1 | 10/1988 |
| FR | 2627090 | A1 | 8/1989 |
| GB | 325435 | | 2/1930 |
| GB | 466901 | | 6/1937 |
| GB | 1 151 656 | | 5/1969 |
| GB | 2 223 686 | A | 4/1990 |
| GB | 2 232 089 | A | 12/1990 |
| IT | 604340 | | 5/1960 |
| NL | 8800024 | | 8/1989 |
| SU | 1253654 | | 8/1986 |
| SU | 1258447 | A1 | 9/1986 |
| SU | 1367987 | A1 | 1/1988 |
| SU | 1 725 744 | A3 | 4/1992 |
| SU | 1743620 | | 6/1992 |
| TW | 210014 | | 7/1993 |
| TW | 317755 | | 10/1997 |
| TW | 331154 | | 5/1998 |
| TW | 364363 | | 7/1999 |
| WO | WO 86/06644 | A1 | 11/1986 |
| WO | WO 90 09212 | A1 | 8/1990 |
| WO | WO 92/18202 | A1 | 10/1992 |
| WO | WO 94/14505 | A1 | 7/1994 |
| WO | WO 96/1455 | A1 | 9/1996 |
| WO | WO 01/19462 | A1 | 3/2001 |
| WO | WO 01/66195 | A2 | 9/2001 |

OTHER PUBLICATIONS

BFit® University Presents Bally "Total Fitness PowerPump the Official Barbell Workout," Training Manual (1988).

The Body Bar, "A Total Body Conditioning Bar." brochure, The Step Company (1995).

Body Masters MD 504 Pec Contractor & Rear Deltold Machine, brochure (1994).

Body Pump ™, "Aerobic Market 'Pumped Up' about New Zealand's Body Pump™ Program, " Press Release, Les Mills International/The STEP Company (date unknow)

Body Pump™, "Anybody and Everybody Wants to . . . Become Some Body" Brochure, A Product of The STEP Company and Developed by Les Mills Aerobics (date unknown).
Body Pump™, "Become Some Body!", Press Release, Les Mills International/The STEP Company (date unknown).
Body Pump™, Instructor Manual Version II©, Les Mills International/The STEP Company (1998).
Body Pump™, "Taking a Good Idea One STEP Further," Press Release, The Step Company/Les Mills International (date unknown).
Body Pump™, Trainer Manual Version II©, Les Mills International/The STEP Company (1998).
Body Pump Training Brochure, The STEP Company/Les Mills International (date unknown).
Bowflex advertisement flyer and order form "Special Offer! Order in 30 Days and Receive an Extra 100lbs of Power Rods FREE!", 10 pages (1992).
"Bowflex Fitness", Bowflex, Inc., catalog, 8 pages (1998).
"Cross Bow by Weider How Does the Crossbow Stack up Against the Competition", ICON Health and Fitness, located at http://www.iconfitness.com/crossbow/cb_vs_bf.html, 2 pages (retrieved Oct. 22,2002).
Cybex International, Inc., Commercial Strength Systems Brochure, 4535 Arm Curl, 5255 Rear Delt, 5281 Arm Curl, pp. 9 and 36 (Apr. 2000).
Cybex International, Inc., Cybex Eagle Premier Strength brochure, 11080 Arm Extension, p. 8 (May 2002).
Cybex World, "New Products Prove Passion for Human Performance," vol. 10, Issue 2 (Jul. 2000).
"HD 1800 Inner/Outer Thigh, " Hoist Fitness Systems, Inc., locatedat http://www.hoistfitness.com, 3 pages (retrieved Apr. 30, 1004).
Introducing. . . Nautilus for Women by Dan Baldwin, National Fitness Trade Journal, pp. 44-47 (date unknown).
Johnny G Spinning© Instructor Manual, Copyright (1995).
Keiser® Power Pacer, Instructor Training Manual©, by Keiser Corporation (1977, 1998).
"MG-32 Ski Machine" and "MG-034 Simple Body Stretcher", Modas Shing Co., Ltd., 1 page (undated).
Maximize Your Performance, "the ultimate workout" Versatrainer by Pro-Max, 1 page (undated).
Nautilus catalog,93 pages (undated).
Nautilus® Fitness Accessories 2001 brochure, 15 pages (2001).
Nautilus® Free Weight Equipment 2001 brochure, 11 pages (2001).
Nautilus® Home Gyms 2001 brochure, 11 pages (2001).
"Nautilus Next Generation Product Line", Nautilus catalog, 8 pages, (undated).
Nautilus, The Next Generation catalog, 48 pages (undated).
Nautilus NS-4000 picture, one page (undated).
Nautilus Super Smooth Technology, "Equipment Comparison", undated brochure, one page (undated).
"Nautilus Time Machine," Nautilus Inc., cover page of product brochure and one page therefrom, 2 pages (undated).
Nebula Fitness Equipment by Proto Weld, Inc., 4005 – Lever Row Swivel Adjustments, brochure (received by USPTO Sep. 1995).
New Fitness Trend Guarantees Company's Success, Press Release, The STEP® Company (undated).
"Odyssey 5" Home Gym, TuffStuff, cover page of Product Prochure and Three images therefrom, 2 pages (2001).
PowerLine by TuffStuff, Task Industries Inc., PL-221, Leg Curl/Extension Combo (undated brochure).
Schwinn Cycling & Fitness Inc., "Airdyne® Backdraft™ Recumbent Bike" (1996).
Schwinn Cycling & Fitness Inc., "Airdyne® Windsprint™ Interval Bike" (1996).
Schwinn®Fitness, "Harness the Force of Nature and You Possess the Strength of Confidence" brochure 30 pages (1996-1997).
Schwinn Iron Classic Strength Training System by Bowflex® Owner's Manual, 55 pages (1993).
The Slide Home Trainer, "The Professional, Portable Home Slide," brochure, The Step Company (1995).
The Slide Trainer The Professional Slideboard, "The Professional Slideboard," brochure, The Step Company (1995) Soloflex catalog, p. 23 (1981).
"Stamina LT-2000 Band Flex Gym", Stamina Products, Inc., located at Egghead.com, 3 pages (at least as early as Mar. 9, 2001).
"The Standing Firm System", located at http:www.standing-pilates.com, 6 pages (retrieved Sep. 29, 2004).
The STEP® Company Club Price List, Les Mills International/The Step Company (May 1998).
The Step® Home Trainer, "The Intermediate Home Step System," brochure, The Step Company (1995).
The Step® Home Workout System, "The Compact Professional Step Trainer," The Step Company (1995).
The Step, "The Original Health Club Step," brochure, The Step Comnpany (1995).
The Step, "The Professtional Club Model," brochure, The Step Company (1995).
The Studio Step, "TheCompact Club Model," brochure, The Step Company (1995).
TuffStuff, TUB-49 Upper Body Machine, brochure (received by USPTO Mar. 1998).
Universal 1981-82 catalog, p. 12 (Jun. 1, 1981).
"V5 Multi Gym," Hoist Fitness Systems, Inc., located at http://www.hoistfitness.com, 3 pages (retrieved Apr. 30, 2004).
Little, John, Chest Essentials, Muscle & Fitness, pp. 183-144 (Sep. 1995).
Tuff Stuff Catalog, page 3, (received by the USPTO Mar. 1998).

* cited by examiner

EXERCISE MACHINE WITH INFINITE POSITION RANGE LIMITER AND AUTOMATIC BELT TENSIONING SYSTEM

FIELD OF THE INVENTION

The present invention relates generally to exercise equipment, and relates more specifically to exercise equipment that enables the user to select an appropriate range of motion for the exercise.

BACKGROUND OF THE INVENTION

Many currently available exercise machines are designed to include an exercise arm or other member that moves in response to a force applied by the user of the machine. Typically, the exercise arm is connected to a resistance system, often a weight stack, that provides resistance to movement of the arm. Thus, as the user attempts to move the arm, the resistance system resists that movement, with the effect that the user exercises by repeatedly overcoming the resistance and moving the exercise arm.

Many exercise machines are configured so that a user can preselect certain exercise parameters. For example, if a weight stack is employed as the resistance system, the user typically can select any number of weights in the weight stack to provide resistance to movement. As a result, the user can customize an exercise routine that is best suited to the user's needs.

Some exercise machines have other features that enable a user to customize the exercise routine further. One example of such a feature is the so-called "range-limiter," which is a device that enables the user to select the endpoints for the path the exercise arm will travel during exercise. A range limiter is particularly useful for exercise machines such as torso machines and hip-and-back machines, both of which condition and rehabilitate body regions which vary in flexibility and strength significantly between users and which are often injured, either acutely or chronically, and therefore can require limited range of motion exercise.

An exemplary and common range-limiting device, such as that illustrated in U.S. Pat. No. 5,356,360 to Johns, includes a range limiting cam that has a series of holes, any of which can receive a pin that is attached to a lever. The lever is attached to the frame of the exercise machine, and the cam is interconnected with the exercise arm. Movement of the pin to different holes determines the range of motion of the exercise device. A somewhat similar range limiter is shown in U.S. Pat. No. 5,263,914 to Simonson et al., in which range limiting capability is provided by a lever having holes that receive a limiting pin.

One shortcoming of each of these range limiters is their inability to provide "infinite" range limiting; i.e., the range of these devices is limited by the number and positions of the holes in the cam or lever. Such a machine may be unsuitable for exercisers having special exercise needs that may require the exercise machine to take a specific position that is not available with the holes offered by the lever or cam.

In addition, the range limiters of these machines are difficult, if not impossible, to adjust during exercise. As a result, a user that wishes to begin the exercise with a certain range of motion, then continue the exercise with a different range of motion, must actually cease the exercise, dismount the exercise machine, modify the range limits, remount the machine, and only then continue exercising. An exercise pattern of gradually increasing range of motion is not unusual, especially for rehabilitating exercisers who require that the portion of the body being exercised be stretched gradually to the point of full motion.

Another type of range limiter is disclosed in U.S. Pat. No. 5,104,121 to Webb, which illustrates a range limiter in conjunction with a torso exercise machine. The Webb range limiter includes a pair of sprockets mounted on a common shaft: one sprocket rotates with an eccentric cam attached to the exercise arm; and the other sprocket, which is larger than the first sprocket, rotates independently of the cam and is attached to the weight stack. A pawl having a latching tooth is attached to the larger sprocket. To establish an exercise starting position, the pawl is disengaged from the smaller sprocket via a handle, and the exercise arm is moved to a desirable starting position. The handle is then released, and the pawl is received between a pair of teeth of the smaller sprocket. The interaction between the pawl and the smaller sprocket fixes the sprockets relative to one another, which in turn connects the exercise arm and the weight stack. As a result, the relative positions of the small and large sprocket establish the starting position for the exercise arm. Although this system enables the user to select a range limit while seated in the exercise machine, it does not provide for infinite range limiting capability, as the range limits of the machine are restricted to discrete positions defined by the configuration of the sprockets and the pawl.

Another shortcoming of many exercise machines that employ cables or chains to connect the exercise arm and the weight stack is the inability of such machines to establish and maintain a constant belt tension, even when the machine is not in use. These machines should have slight tension (between 5 to 20 pounds) on the belts or chains in order to ensure that resistance is provided during the entire exercise stroke, and in particular at the beginning of the stroke. Most exercise machines of this type require periodic maintenance, during which time the belt or chain is disconnected from the weight stack. When the belts or chains are reconnected after maintenance, the tension must be re-adjusted.

Also, at times exercise machines malfunction by the lower end of the connecting rod that carries the weight becoming lodged against the top surface of the uppermost weight remaining in the weight stack. As a result, the weights connected with the connecting rod are suspended in a raised position. When this occurs, often the user will attempt to fix the problem by dislodging the lower end of the connecting rod. In response, the weights connected to the connecting rod immediately drop onto the remaining weights. As such, the user risks serious hand injury by attempting to fix the machine.

SUMMARY OF THE INVENTION

In view of the foregoing, it is an object of the present invention to provide a range-limiting device for an exercise machine that is not limited to a finite number of positions.

It is also an object of the present invention to provide such a range-limiting device that can be operated by the user when the user is in place to exercise and that can be adjusted between exercise strokes.

It is a further object of the present invention to provide a device that can provide constant tension to a belt or chain of an exercise machine.

These objects and others are satisfied by the present invention, which includes an exercise machine having infinite range limiting capability. The exercise machine of the present invention comprises: a frame; a pivotable exercise arm mounted to the frame configured to engage an exercising user and moveable along a stroke path having a fully extended position and a fully flexed position; movement-resisting means for resisting movement of the exercise arm along the stroke path; interconnecting means for interconnecting the exercise arm and the movement-resisting means so that movement of the exercise arm causes a portion of the movement-resisting means to move in response thereto; and range-limiting means for limiting the distance the exercise arm moves along the stroke path during exercise. The range-limiting means is connected to the interconnecting means and is configured to enable a user of the exercise machine to select a first partially flexed position at any desired location along the stroke path such that the exercise arm moves between the first partially flexed position and the fully extended position serving during exercise. The range limiting means is also configured so that movement of the exercise arm away from the fully extended position past the first partially flexed position by the user selects a second partially flexed position such that the exercise arm moves between the second partially flexed position and the fully extended position during exercise. With an exercise apparatus that is so configured, the user can set a new range limit (i.e., the second partially flexed position) merely by repositioning the exercise arm; he need not dismount the apparatus nor rely on a separate actuator.

Preferably, the exercise apparatus also includes a tensioning unit. Such an exercise apparatus includes the aforementioned frame, exercise arm, and movement resistance means, and interconnecting means, and also includes tensioning means. The interconnecting means includes a flexible member between the exercise arm and the movement-resisting means. The tensioning means, which is interconnected with the interconnecting means, maintains tension in the flexible member when the exercise arm is in the flexed position and when the exercise arm is in the extended position. This simplifies set-up and adjustment of the tension in the machine, and can also prevent accidents that occur when the connecting pin of an exercise machine becomes lodged above the weight stack.

DETAILED DESCRIPTION OF THE INVENTION

The present invention will now be described more particularly hereinafter with reference to the accompanying drawings, in which an embodiment of the invention is shown. The invention can, however, be embodied in many different forms and should not be limited to the embodiment set forth herein; rather, this embodiment is provided so that this disclosure will be thorough and complete and will fully convey the scope of the invention to those skilled in this art.

Figure 1:
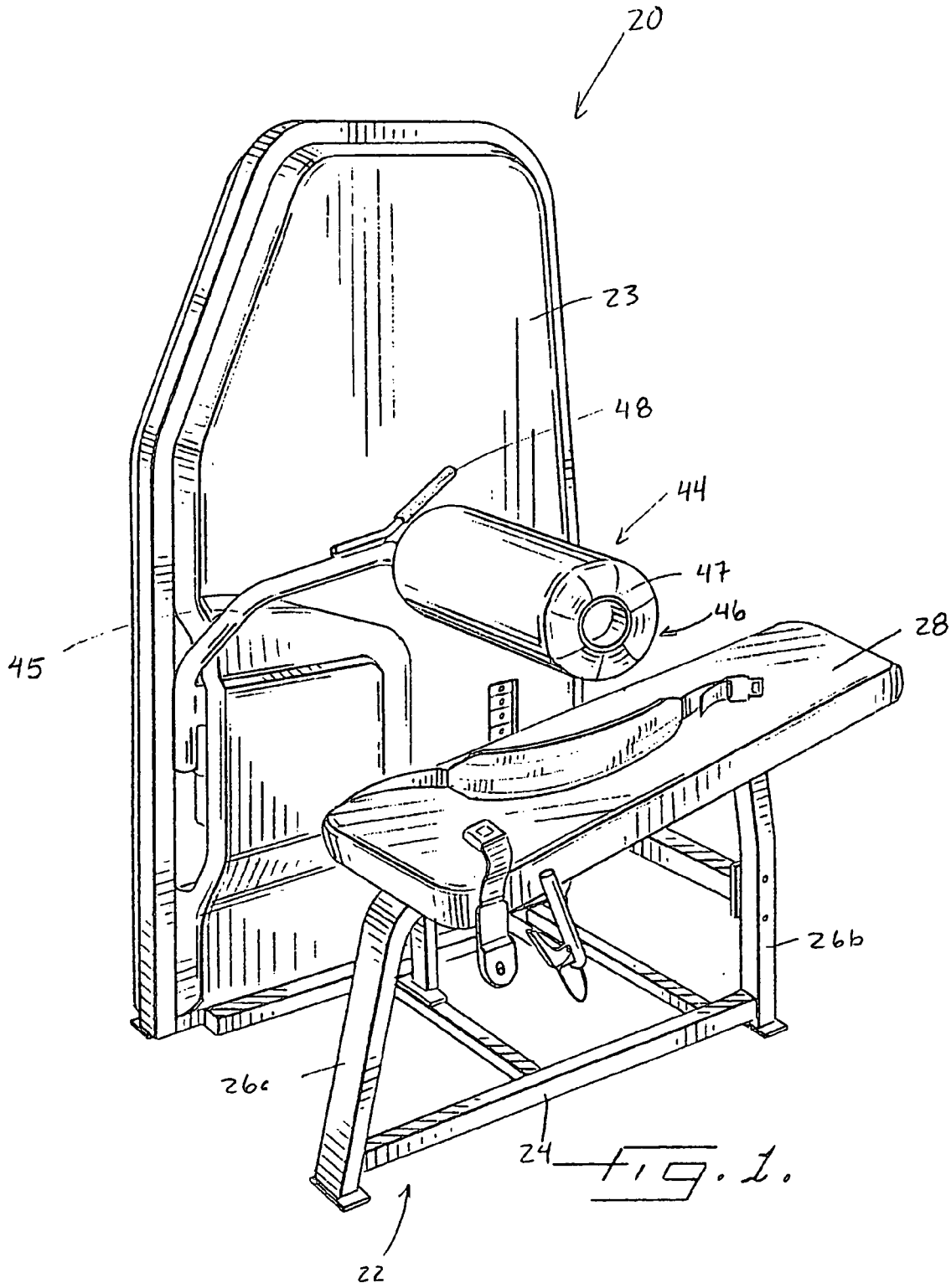
FIG. 1 is a front perspective view of a hip and back machine of the present invention.
Figure 2:
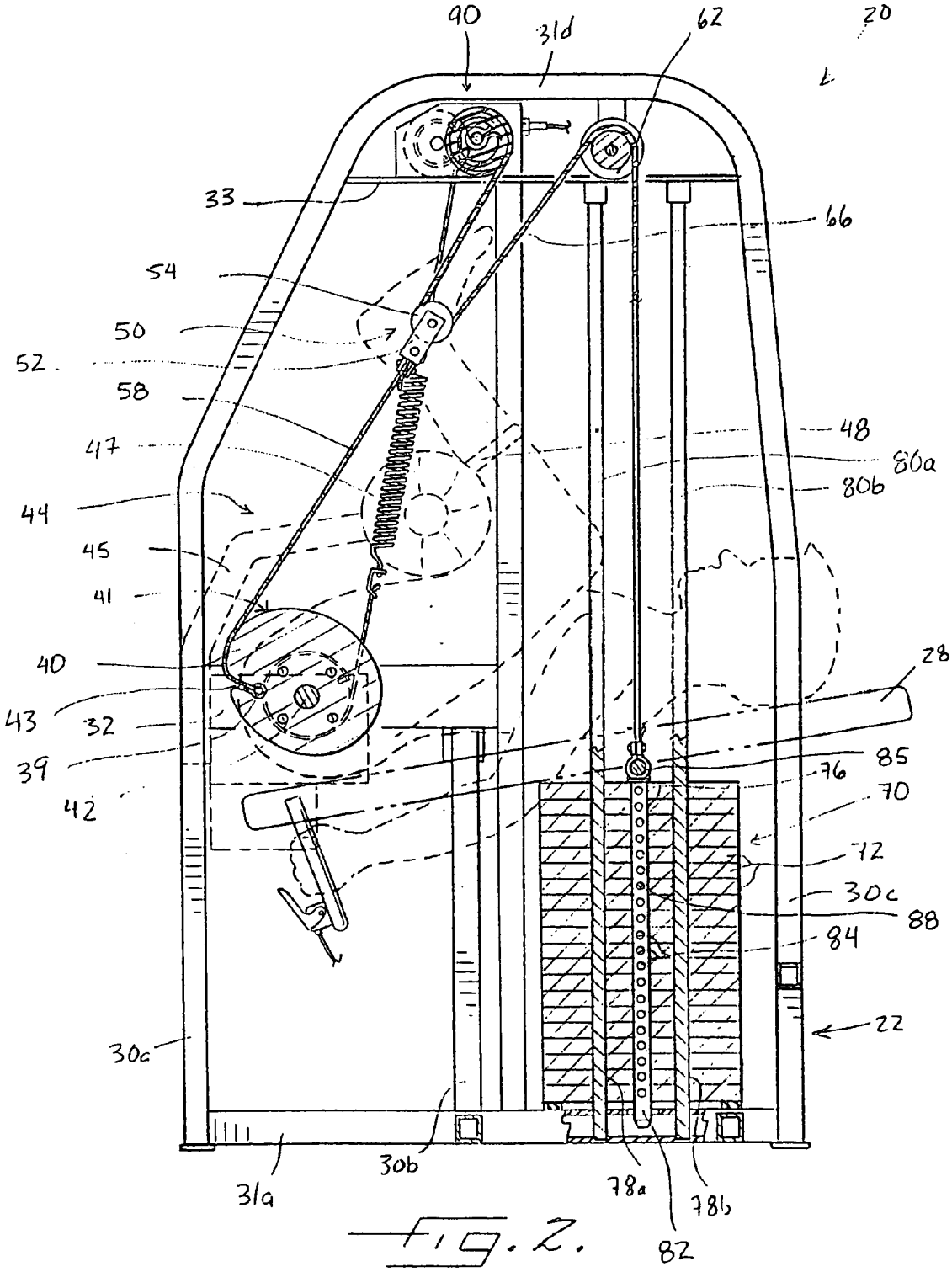
FIG. 2 is a side section view of the hip and back machine of FIG. 1 with a user illustrated in phantom line and with the weight exercise arm in its flexed position.

Referring now to the Figures, a hip-and-back machine 20 is illustrated in FIGS. 1 and 2. As seen in FIG. 1, the leg extension machine 20 includes a skeletal frame 22, a portion of which is covered by a plastic cover 23. The frame 22 includes a base assembly 24 upon which rests a platform 28 configured to receive a reclining occupant for exercising. The platform 28 is supported by two vertical platform supports 26*a*, 26*b*.

As best seen in FIG. 2, the frame 22 also includes three generally upright members 30*a*, 30*b*, 30*c* which are connected at their lower ends by a horizontal cross-member 31*a*. The upright members 30*a* and 30*b* are connected at their medial portions by a horizontal cross-member 31*b*. The upright member 30*b* terminates at its upper end at a range limiter support 33, which extends horizontally between the upper end portions of upright members 30*a* and 30*c*. The upright members 30*a* and 30*c*, which are formed from a common tube, merge at their upper ends with a horizontal cross-member 31*d*. Also, a cam support 32 extends between the upright members 30*a*, 30*b* slightly above the height of the platform 28. Although the illustrated frame configuration is preferred, those skilled in this art will appreciate that other frame configurations can also be employed with the present invention.

Referring again to FIGS. 1 and 2, an exercise arm 44 is positioned above the front end (i.e., the end above a reclining occupant's torso) of the platform 28. The exercise arm 44 includes a crank portion 45, which is pivotally mounted to the cam-support 32 through a cam shaft 42. The crank portion 45 follows a generally upwardly and rearwardly-extending arcuate path from the cam shaft 24 to a user-engaging portion 46, which extends horizontally therefrom above and generally parallel with the front portion of the platform 28. The user-engaging portion 46 is covered with a cylindrical cushion 47, which is positioned to engage the user behind the knees during exercise, and includes a grasping handle 48.

Still referring to FIG. 2, an eccentric cam 40 is mounted to the cam shaft 42 on the same side of the cam support 32 as the exercise arm 44. The cam 40 includes an arcuate camming surface 41 about its periphery; the camming surface 41 is of sufficient width to engage an overlying cam belt 58 during operation. A slot 43 is positioned at one end of the camming surface 41; the slot 43 receives one end of the cam belt 58 and fixes it to the cam 40 via an attachment pin 39. The cam 40 is configured so that, as the camming surface 41 wraps the cam belt 58, the resistance provided to the user varies over the "stroke" of exercise to increase the benefit the user receives. The skilled artisan will recognize that other configurations, such as those in which cams of other eccentric or non-eccentric shapes are employed, can also be used with the present invention.

An idler pulley unit 50 is attached to the cam belt 58 at the end opposite the cam 40 (FIG. 2). The idler pulley unit 50 includes the cam belt 58, a carrier bracket 52 that is attached to the end of the cam belt 58 opposite the cam 40, and an idler pulley 54 rotatably mounted on the carrier bracket 52. Of course, the cam belt 58 can be replaced with a chain or other flexible member if the cam 40 is correspondingly configured.

Still referring to FIG. 2, the idler pulley unit 50 is suspended by a weight belt 66 that engages the idler pulley 54. The weight belt 66 is secured at one end to a range limiting unit 90 that is mounted on a forward portion of the range-limiting support 33. From its engagement with the idler pulley 54, the weight belt 66 travels upwardly and rearwardly to engage a large positioning pulley 62 mounted on the rear portion of the range limiter support 33. The weight belt 66 then travels downwardly to interconnect with a weight system 70. As with the cam belt 58, the weight belt 66 can be replaced with a chain or other flexible member with corresponding changes in the idler pulley 54 and the positioning pulley 62 (e.g., sprockets can be substituted for the pulleys if a chain replaces the weight belt 66).

Referring again to FIG. 2, the weight system 70 includes a plurality of vertically stacked weights 72. Each of the weights 72 includes a horizontally-extending selection pin aperture (not shown) in one side wall and a vertically-extending connecting rod aperture 76 which intersects with the selection pin aperture 74 at the center of the weight 72. Each weight 72 also includes a pair of guide rod apertures 78*a*, 78*b*, which extend vertically through the weight 72 on opposite sides of the connecting rod aperture 76. The guide rod apertures 78*a*, 78*b* and the connecting rod apertures 76 are positioned on each weight 72 so that, as the weights 72 are vertically stacked, the guide rod apertures 78*a*, 78*b* and the connecting rod apertures 76 are aligned to form passages in the weight stack.

Referring still again to FIG. 2, the weights 72 are maintained in their x-y positions (i.e., their positions along axes extending horizontally across FIG. 2 (the x-axis) and extending normal to the page in FIG. 2 (the y-axis) and their angular orientations relative to the frame 22 about a vertical axis by a pair of cylindrical guide rods 80*a*, 80*b*. The guide rods 80*a*, 80*b* extend vertically between and are fixed to the cross-member 31*a* and the range limiter support 33. Each guide rod 80*a*, 80*b* extends through a respective aligned set of guide rod apertures 78*a*, 78*b* in the weights 72 as they are vertically stacked. Two bushings (not shown) are slidably received on respective guide rods 80*a*, 80*b* and engage the uppermost of the weights 72.

A connecting rod 82 (FIG. 2) is connected to the end of the weight belt 66 that extends downwardly from the positioning pulley 62; this connection is achieved via a bracket 85 attached to the upper end of the connecting rod 82. The connecting rod 82 extends downwardly through the connecting rod apertures 76 in the weights 72. The connecting rod 82 includes apertures 84 which, when the connecting rod 82 is in a lowered position, align with corresponding selection pin apertures 74 of the weights 72. Thus, by inserting a selection pin 88 into the selection pin aperture 74 of a desired weight 72 and the corresponding aperture 74 of the connecting rod 72, a desired number of weights 72 can be interconnected with the exercise arm 44 to provide resistance to the movement thereof.

Although the illustrated weight system 70 is preferred., other systems in which weights are interconnected with the exercise arm 44 can also be employed with the present invention. For example, multiple weight stacks, such as those described and illustrated in co-assigned and co-pending U.S. patent application Ser. No. 08/691,693 can be employed.

As mentioned above, the range limiting unit 90 (FIG. 4) is connected with the end of the weight belt 66 opposite the weight system 70 and is mounted on the range limiter support 33. The range limiting unit 90 comprises a block housing 91, a clutch pulley unit 100, a drive gear unit 120, and an actuation system 150. These components are described in more detail hereinbelow.

The housing 91 (FIGS. 4, 7 and 8) is a solid steel block comprising side walls 92*a*, 92*b* and a rear wall 93. A hub aperture 98 and a drive pulley shaft aperture 99 each extend through the housing 91 between the side walls 92*a*, 92*b*. The rear wall 93 includes an actuator aperture 95 that intersects with the hub aperture 98. The side wall 92*a* also includes a circular coil spring recess 96 in its forward portion that has a tangentially-extending slot 97.

Referring again to FIGS. 4, 7 and 8, the clutch pulley unit 100 comprises a clutch pulley 101 having an integral clutch pulley shaft 102, a hub 103 and a pinion 108. The clutch pulley 101 is attached to the end of the weight belt 66 opposite the weight system 70 and is rotatably mounted within the hub 103 via the clutch pulley shaft 102. The clutch pulley 101 is configured to take up the weight belt 66 upon rotation thereof in the direction that is counterclockwise from the reference point illustrated in FIG. 2.

The hub 103 is mounted within the hub aperture 98 in the housing 91, with the clutch pulley shaft 102 being mounted within the central apertures of the hub 103 and being retained on the shaft by an E-type retaining ring 107. The hub 103 has an internal one-way clutch mechanism formed by clutch members 104. Such one-way clutches are well-understood by those skilled in this art and need not be described in detail herein. The presence of these members 104 prevents the clutch pulley shaft 102 from rotating in the direction relative to the hub 103 that would enable the weight belt 66 to unwrap from the clutch pulley 101 (clockwise from the vantage point of FIG. 2). The hub 103 also includes four recesses 106 spaced equally apart about its circumferential outer surface 105.

Figure 4:
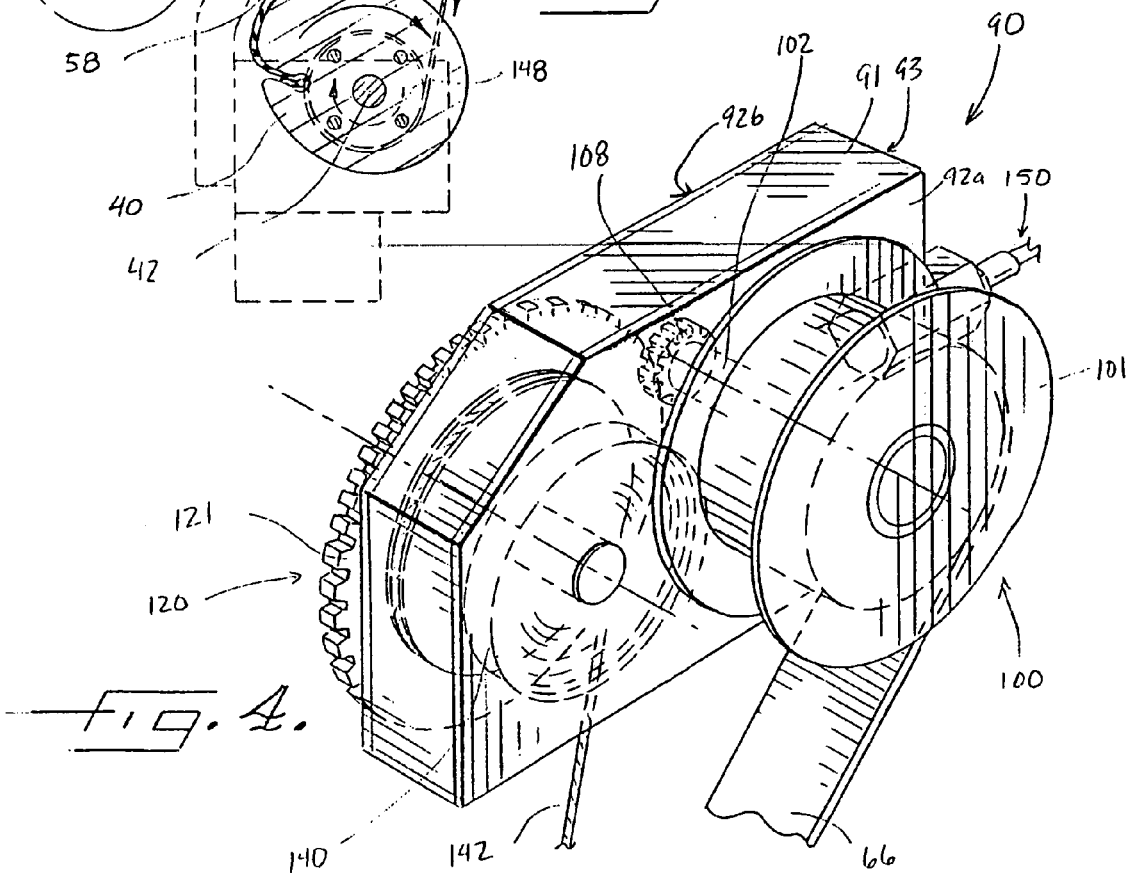
FIG. 4 is an enlarged perspective view of a range limiting unit included in the hip and back machine of FIG. 1.
Figure 7:
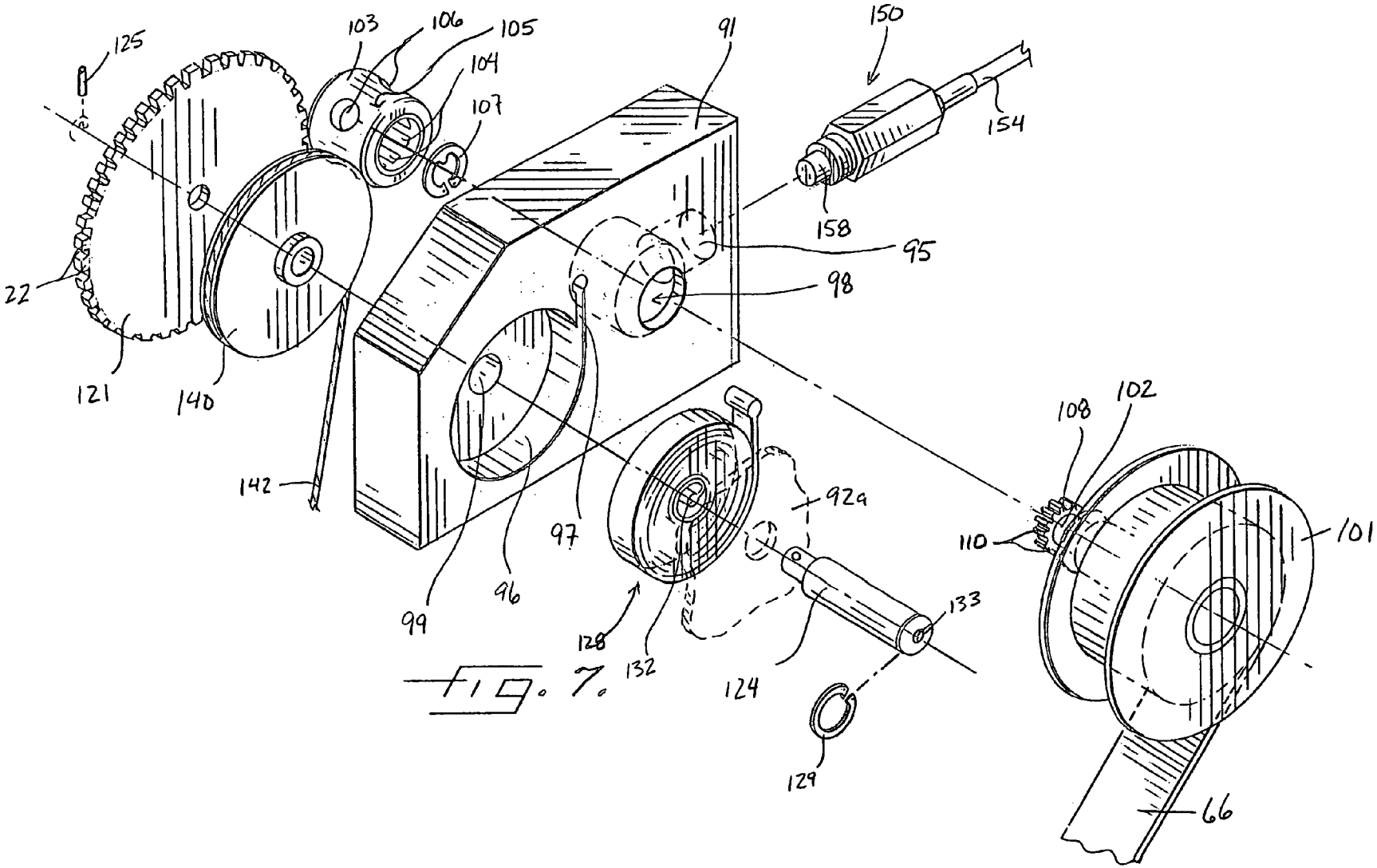
FIG. 7 is an enlarged exploded perspective view of the components of the range limiting unit of the hip and back machine of FIG. 1.
Figure 8:
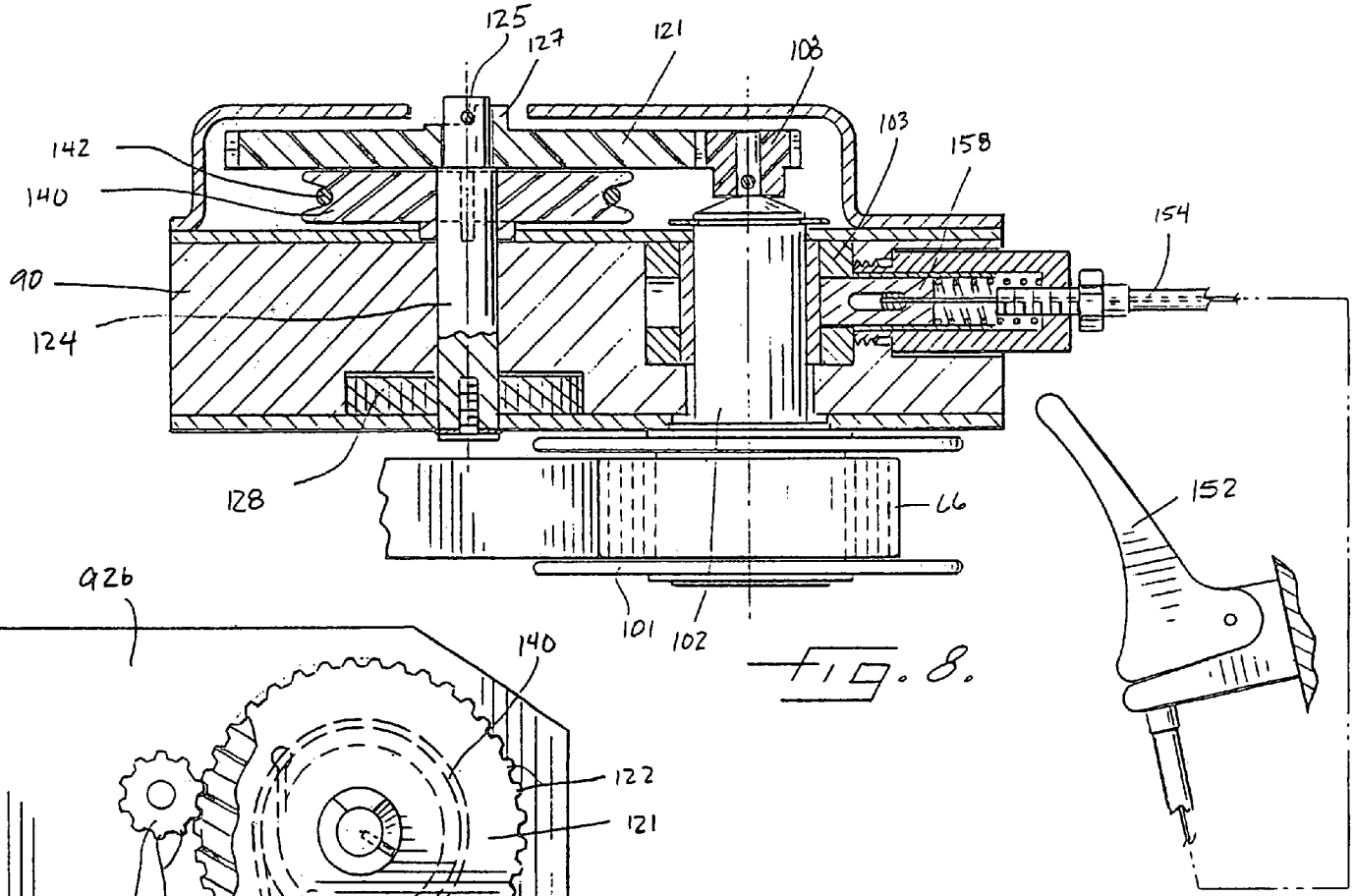
FIG. 8 is an enlarged top section view of the range limiting unit of the hip and back machine of FIG. 1 with the shoulder pin of the actuator system in its extended position.

Still referring to FIGS. 4, 7 and 8, on the side of the housing 90 opposite the clutch pulley 101, the clutch pulley shaft 102 is connected to the pinion 108. The pinion 108, which is about 1 inch in diameter and has radially extending teeth 110, is fixed to the clutch pulley shaft 102 so that the clutch pulley 101 and the pinion 108 always rotate as a unit.

Referring again to FIGS. 3, 4, 7 and 8 and moving forward on the housing 91, the drive gear unit 120 includes a drive gear 121, a drive gear shaft 124, a take-up pulley 140, a power spring 128, and a cam pulley 148. The drive gear 121 is positioned adjacent to the pinion 108. The drive gear 121 is mounted on the drive gear shaft 124, which extends through the drive pulley shaft aperture 99 of the housing 90.

Figure 9:
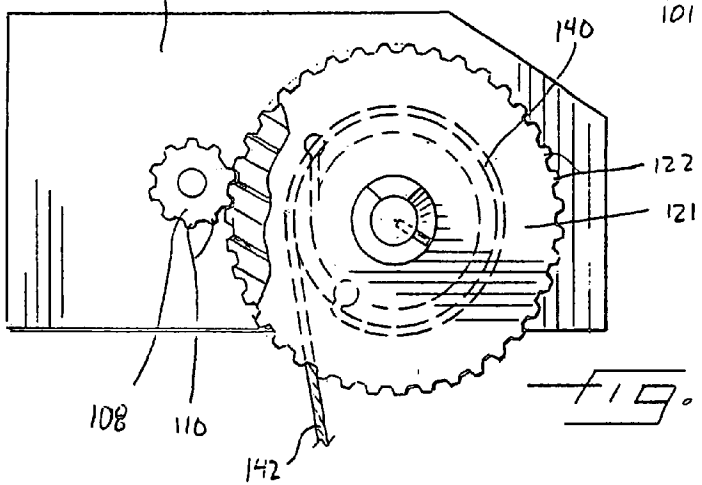
FIG. 9 is an enlarged side view of the pinion and drive gear of the range limiting unit of the hip and back machine of FIG. 1.
Figures 10, 11, 12, 13:
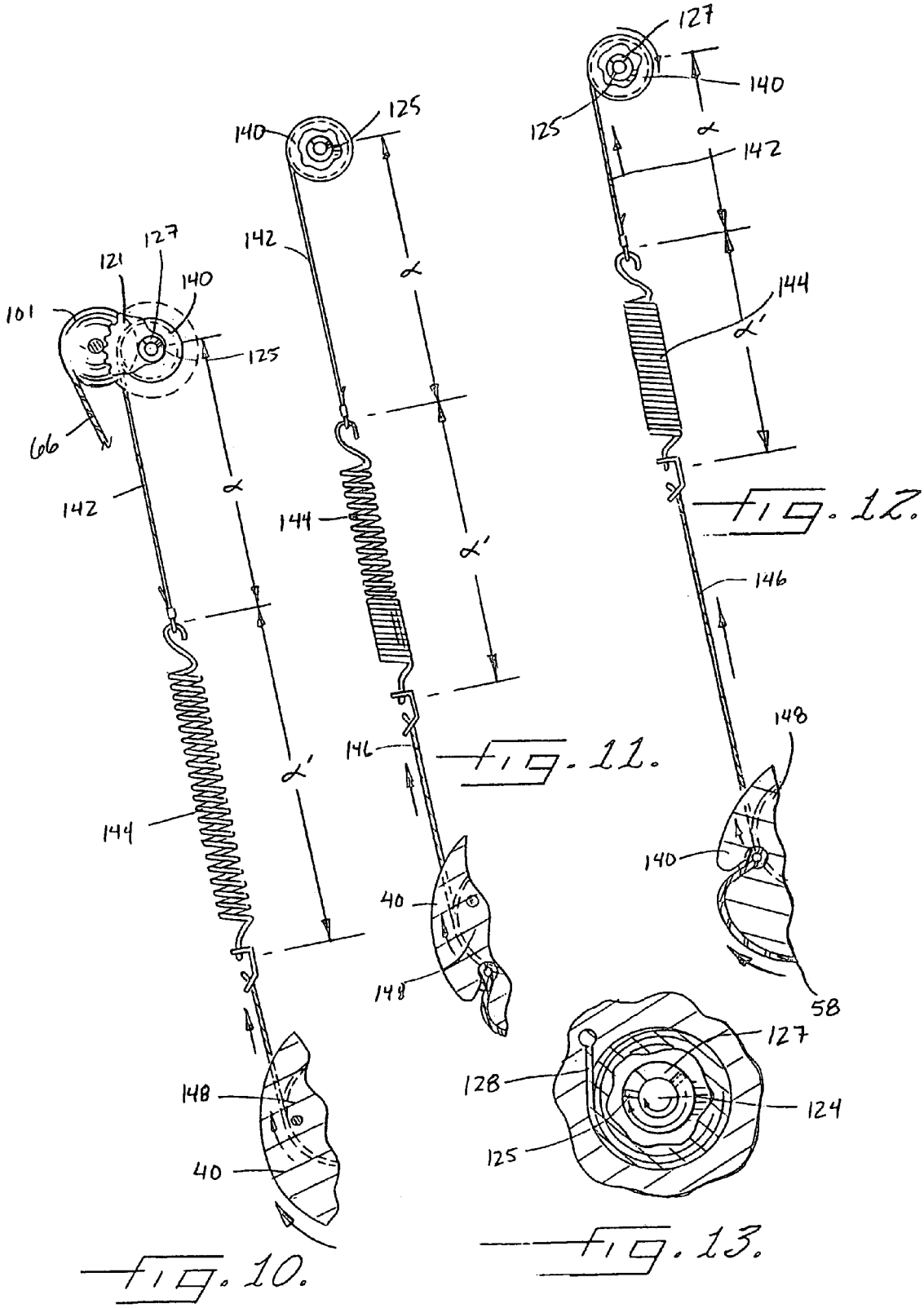
FIG. 10 is a partial side view of the cable system of the hip and back machine of FIG. 1, with the helical spring included therein extended beyond its free length.
FIG. 11 is a partial side view of the cable system of the hip and back machine of FIG. 1 with the helical spring included therein partially extended.
FIG. 12 is a partial side view of the cable system of the hip and back machine of FIG. 1 showing the helical spring at its free length.
FIG. 13 is an enlarged section view of the drive gear and take-up pulley of the range limiter showing the relative position of the stop pin and the ridge of the drive gear as the stop pin rotates with the shaft.

The drive gear 121 is free to rotate about the drive gear shaft 124 over an angular range of about 190 degrees; this angular range is defined by a stop pin 125 mounted on the shaft 124 and a ridge 127 on the lip of the drive gear 121 (see FIGS. 7, 9 and 13). The drive gear 121 is about 5 inches in diameter and includes radially-extending teeth 122 that are sized to engage the teeth 110 of the pinion 108.

Referring now to FIGS. 7 and 8, at its end opposite the drive gear 121, the drive gear shaft 124 is attached to the rotating end 132 of the coiled power spring 128 via a slot 133. The power spring 128 is coiled about the shaft 124 within the recess 96 in the housing side wall 92*a*, with the end of the power spring 128 that is opposite the shaft 124 being fixed within the slot 97 in the housing side wall 92*a*. The power spring 128 is sized and configured to bias the shaft 124 to rotate in the counterclockwise direction from the vantage point of FIG. 2. A retaining ring 129 retains the drive gear shaft 124 in place in the housing 91.

Shown best in FIGS. 9 through 12, the take-up pulley 140 is mounted to the drive gear shaft 124 for coupled rotation therewith. The take-up pulley 140 is configured to take up a portion of a downwardly-extending upper cable 142, which is attached at one end to the take-up pulley 140. The upper cable 142 is attached at its opposite end to one end of a helical spring 144, which is in turn attached at its opposite end to one end of a lower cable 146. The lower cable 146 is attached at its opposite end to the cam pulley 148, which is mounted on the cam shaft 42 for coupled rotation with the aforementioned cam 40. The upper and lower cables 142, 146 and the helical spring 144 are sized so that, during most operation of the hip-and-back machine 20, the helical spring 144 is stretched beyond its free length and therefore maintains the cables 142, 146 in tension.

Referring now to FIGS. 2, 7 and 8, the actuation system 150 comprises a handle 152 that is mounted on the platform 28 near the hip of a user. The handle 152 is connected through a sheath and cable unit 154 to a spring-loaded shoulder pin 158 that is mounted to the end wall 93 of the housing 90 within the actuator aperture 95 (FIG. 8). The shoulder pin 158 is sized to fit within the recesses 106 of the clutch hub 103 and is biased by its spring to extend toward the hub 103 and into a recess 106.

Figure 6:
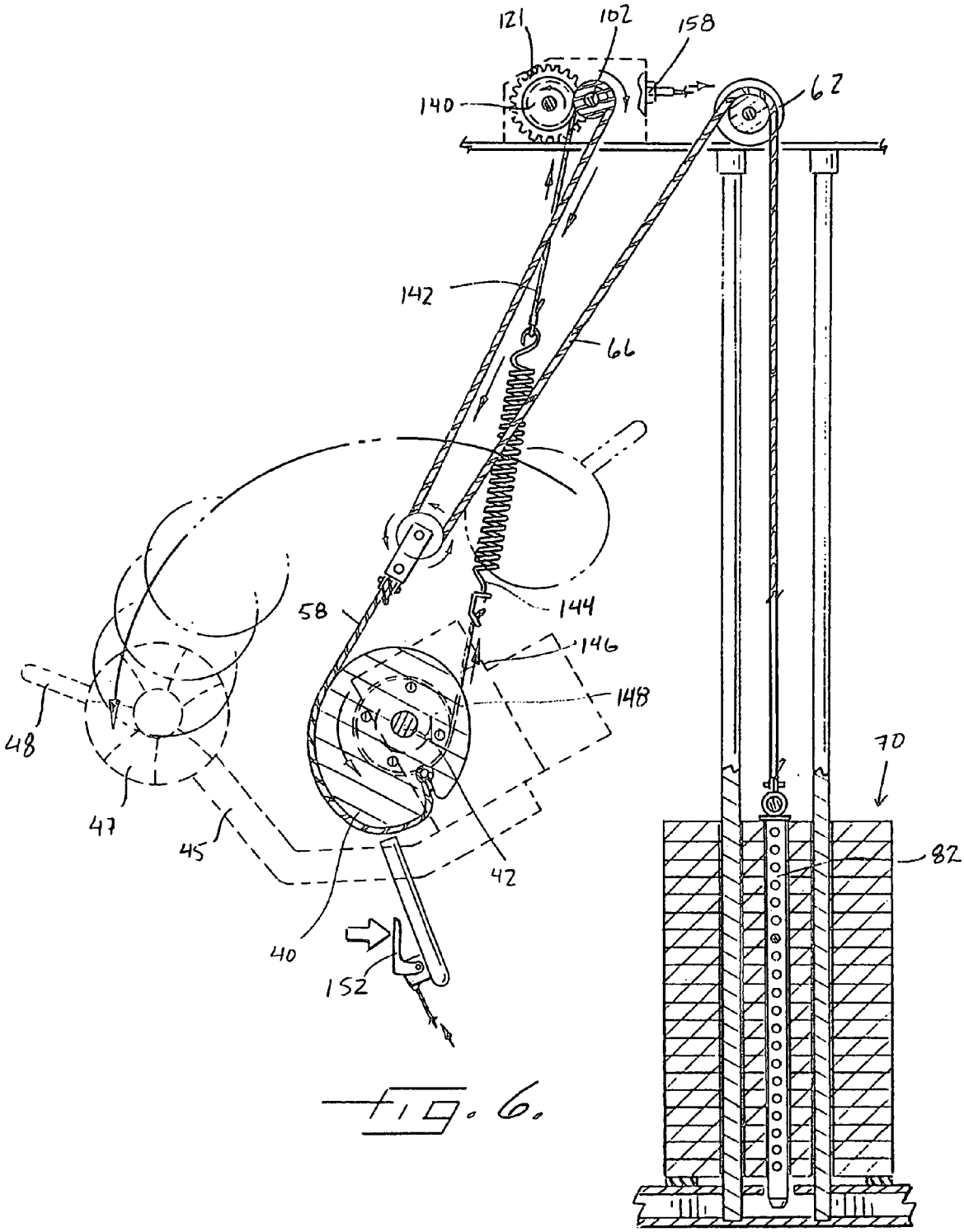
FIG. 6 is a section view of the hip and back machine of FIG. 1 illustratively how the exercise arm can be returned to the extended position after exercise to enable the user to dismount the machine.

Exercise with the hip-and-back machine 20 commences with the exercise arm 44 in its inoperative fully extended position (this position is best illustrated in FIG. 6). In this position, the exercise arm 44 is extended fully forward, the weights 72 of the weight stack 70 are lowered and stacked, and the weight belt 66 is fully unwrapped from the clutch pulley 101. Tension is maintained in the system by the helical spring 144, which is extended beyond its free length, and by the power spring 128, which biases the take up pulley 140 in the clockwise direction from the vantage point of FIG. 6. The biasing of the power spring 128 also biases the drive gear 121 in the clockwise direction, which in turn biases the pinion 108 and, therefore, the clutch pulley 101, in the counterclockwise direction as seen in FIG. 6. The biasing of the clutch pulley 101 causes the weight belt 66 to remain in tension.

Prior to exercising, the user inserts the selection pin 88 into the selection pin aperture 74 that corresponds to the desired number of weights 72 for exercise. The user then lies on his back on the platform 28 and is belted into place (FIG. 2).

The user then pulls on the exercise arm 44 to move the exercise arm 44 to a desired flexed position. Because the clutch hub 103, and in turn the clutch pulley 101, are free to rotate relative to the housing 90, the user can grasp the handle 48 and rotate the exercise arm 44 over his hips and toward his chest to the desired partially flexed position.

Figure 3:
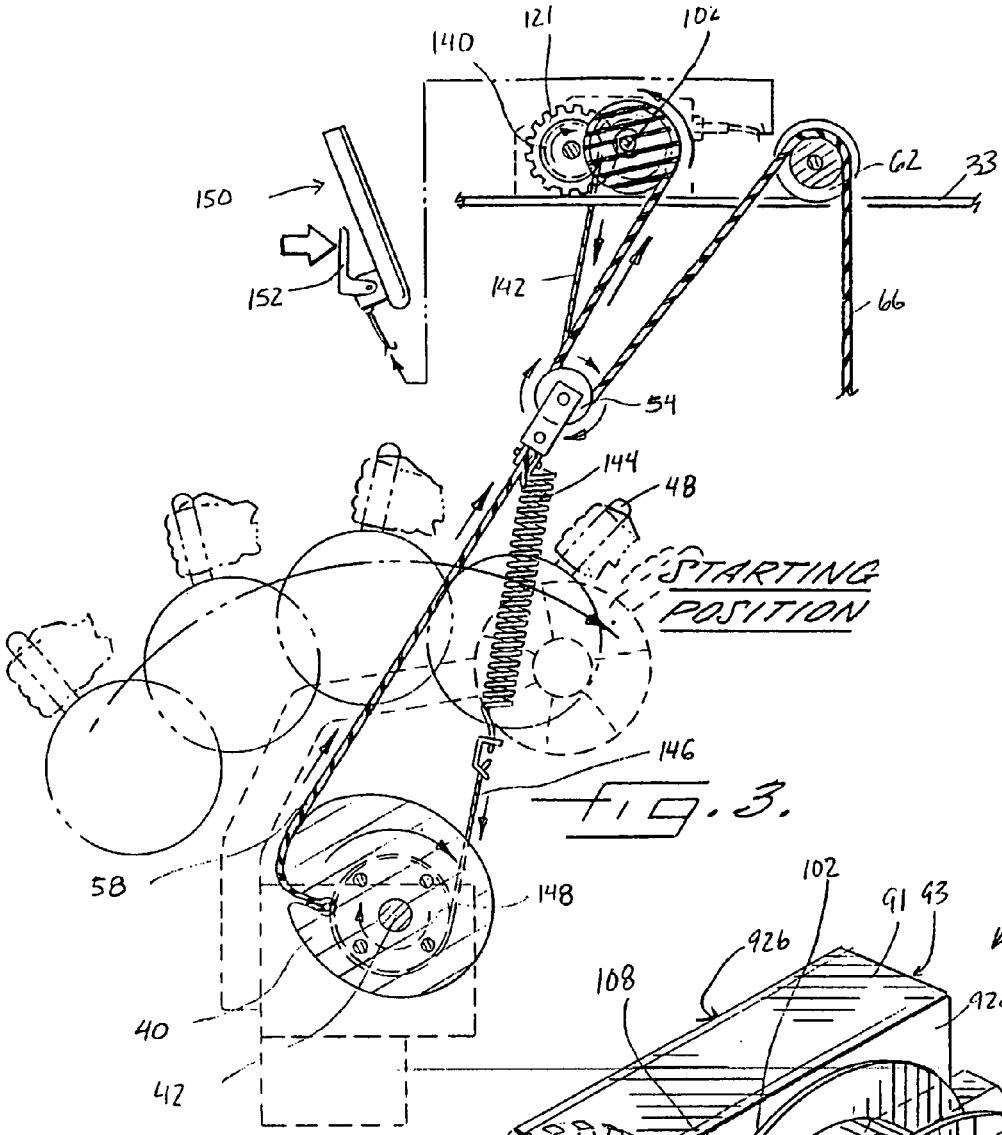
FIG. 3 is an enlarged view of the hip and back machine of FIG. 1 illustrating the rotation of the exercise arm to a flexed position when the range limiting unit is disengaged to enable the weight belt to wrap onto the clutch pulley.

Simultaneously, and as illustrated in FIG. 3, the movement of the exercise arm 44 also causes the cam pulley 148 to rotate and take up the lower portion of the lower cable 146. Wrapping of the lower cable 146 draws the helical spring 144 downwardly, which in turn unwraps the upper cable 142 from the take up pulley 140. The take up pulley 140 rotates the drive shaft 124 and the drive gear 121, as the drive gear 121 is oriented so that the stop pin 125 is in contact with the ridge 127.

Rotation of the drive gear 121 drives the pinion 108, the hub 103, and the clutch pulley 101 counterclockwise from the vantage point of FIG. 3. This rotation of the clutch pulley 101 wraps up a portion of the weight belt 66, with tension being maintained therein.

Figure 5:
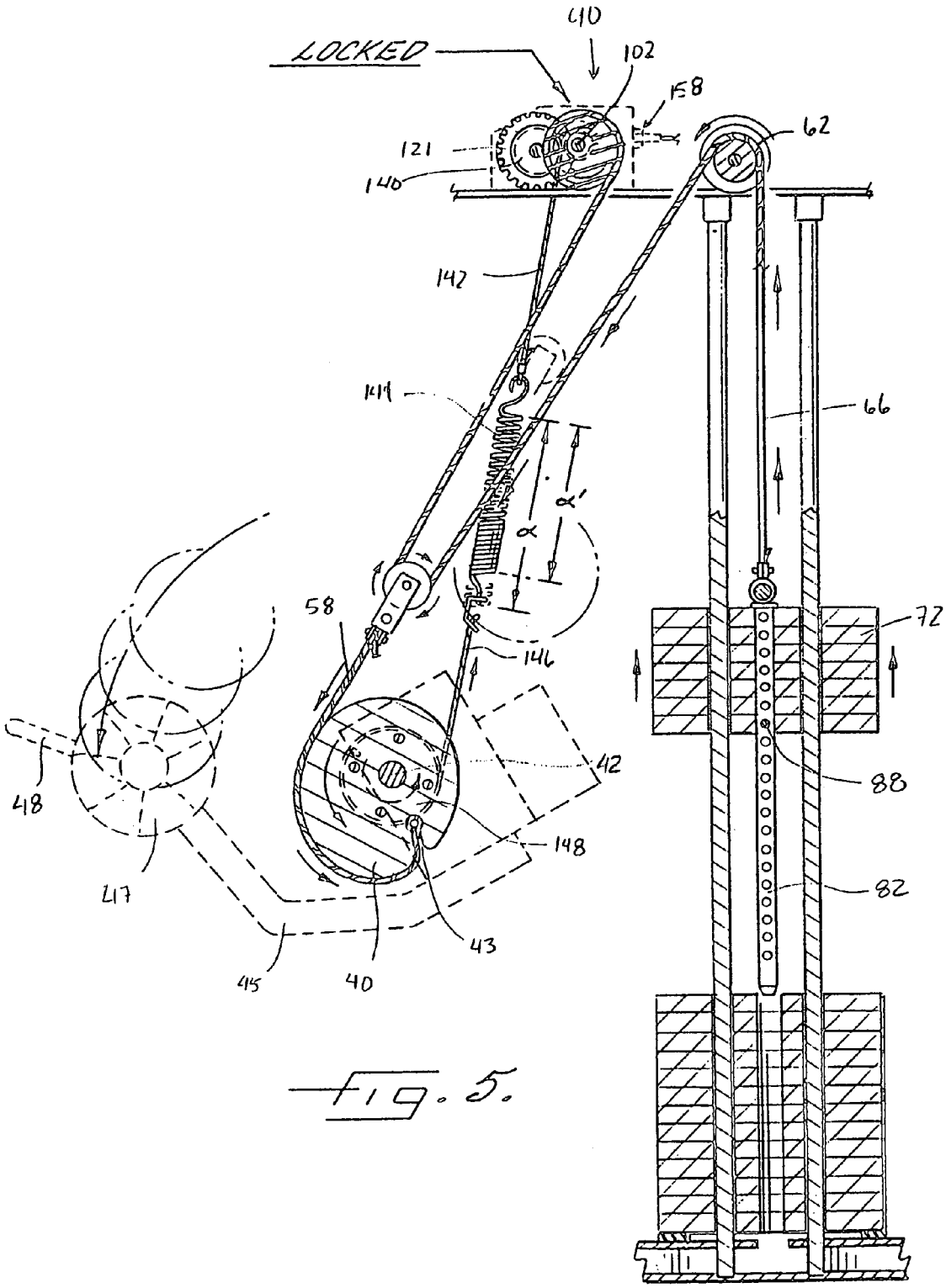
FIG. 5 is a section view on the hip and back machine of FIG. 1 showing the exercise arm in phantom line as it moves to its extended position during exercise.

Once the user has selected the partially flexed position in which to commence exercising, initial slight extension of the user's legs from the partially flexed position toward the fully extended position causes the clutch pulley 101 and hub 103 to rotate within the housing 91 slightly (clockwise in FIG. 5) until one of the recesses 106 in the hub 103 is positioned to engage the shoulder pin 158, which extends to engage that recess (see FIG. 8). With the shoulder pin 158 engaged in a recess 106, the hub 103 is prevented from further rotation. In turn, the clutch pulley 101 is prevented from clockwise rotation within the hub 103 by the one-way clutch members 104. As such, the clutch pulley 101 does not let out any of the weight belt 66; instead, the weight belt 66 is now set at a constant length. As a result, the exercise arm 44 is set in its initial partially flexed position.

After the exerciser has set the "flexed" position, he exercises by extending his legs until the exercise arm 44 reaches the extended position. Doing so causes the cam belt 58 to wrap around the camming surface 41 of the cam 40, thereby drawing the idler pulley 50 lower and lifting the selected weights 72. The clutch pulley 100 remains fixed and neither releases nor takes up more of the weight belt 66. Similarly, neither the pinion 108 nor the drive gear 121 rotate during exercise. However, because the cam pulley 148 rotates with the cam 40, the tension in the cables 142, 146 between the cam pulley 148 and the take-up pulley 140 tends to be reduced as the exercise arm 44 moves nearer the extended position. Because of this, the helical spring 144 interposed between the cables 142, 146 contracts. However, over the final stages of the stroke, as the exercise arm 44 approaches the extended position, the spring 144 contracts to its free length. At this point, the power spring 128 biases the take-up pulley 140 to maintain tension in the cables 142, 146.

If, in the course of exercising, the user wishes to modify the partially flexed position to a location nearer his chest (as may be the case when the user becomes more flexible from the stretching of prior exercise repetitions), the partially flexed position can be adjusted by simply pulling the exercise arm 44 to a new partially (or fully) flexed position nearer the chest. The clutch pulley 101 is permitted to rotate relative to the hub 103 (counterclockwise in FIG. 3) by the one-way clutch members 104 to take up more of the weight belt 66 without raising the weights 72. Thus, the system enables the user to set any desired flexed position, even between exercise repetitions, without leaving the platform 28.

After completing the exercise, the user can easily dismount the hip and back machine 20 by actuating the handle 152 (see FIG. 6). This action retracts the shouldered pin 158 from its receiving recess 106, which in turn enables the hub 103 to rotate within the clutch pulley aperture 98. This action enables the clutch pulley 101 to rotate clockwise (FIG. 6) to let out the weight belt 66 when the user pushes the handle 48 of the exercise arm 44 forwardly to the fully extended position. Rotation of the clutch pulley 101 drives the pinion 108 clockwise, which in turn drives the drive gear 121 counterclockwise. The cam 40 and cam pulley 148 rotate with the exercise arm 44. Tension is maintained during the release of the exercise arm 44 by the spring 144, then by the power spring 128, as described above.

The cam belt 58, the weight belt 66, and the upper and lower cables 142, 146 are maintained in tension by both the helical spring 144 and the power spring 128 that biases the take-up pulley 140. As described above, over most of the stroke of the exercise arm 44, the helical spring 144 is extended beyond its free length, thus creating tension in both cables 142, 146. By doing so, tension remains in the entire system (preferably about 6 pounds). When the stroke of the exercise arm 44 approaches the fully extended position, the helical spring 144 compresses to its free length prior to the exercise arm 44 reaching the extended position. In this instance, the power spring 128 draws the cables 142, 146 and the helical spring 144 upwardly to maintain tension in the system.

It is also noteworthy that the range limiter unit 90 is able to maintain tension in the system despite apparent mismatch of rotation between unit comprising the cam 40 and cam pulley 148, which rotates at the most only about 190 degrees, and the clutch pulley 101, which may rotate up to five times to wrap up the weight belt 66. This difference in rotation is overcome in the sizing of the take-up pulley 140, the drive gear 121 and the pinion 108. Because the drive gear/pinion gear ratio is about 5 to 1, the clutch pulley 101 rotates five times for a single rotation of the drive gear 121. Similarly, the take-up pulley 140 is sized to rotate approximately one time as the cam pulley 148 rotates through 180 degrees. As a result, movement of the exercise arm 44 such that the cam pulley 148 rotates through 180 degrees causes the clutch pulley 101 to rotate five times to wrap up the weight belt 66. Of course, those skilled in this art will recognize that other configurations that convert the desired movement of the exercise arm 44 to the desired take-up of the clutch pulley 101 would also be suitable for use with the present invention.

In addition to the hip and back machine 20 illustrated herein, the range limiter unit 90 can also be employed with other exercise apparatus for which range limiting capability is desired. Examples of other suitable exercise machines include: machines for leg exercise, such as prone leg curl, leg press, seated leg curl, and seated calf machines; machines for hip exercise, such as hip abduction, adduction, and abduction/adduction machines, machines for neck exercise, such as 4-way neck, behind neck, and neck and shoulders machines; machines for the upper torso, such as 10-degree and 50-degree chest, chest and double chest, decline and incline press, bench press, reverse and super pullover, torso arm, seated dip, rowing back, and compound row machines; machines for the mid-torso, such as abdominal, lower abdominal, rotary torso, and low back machines; machines for the arms, such as multi-biceps, multi-triceps, and super forearm machines; and machines for the shoulders, such as lateral raise, overhead press, and rotary shoulder machines.

It should also be apparent to those skilled in this art that the range limiting unit 90 can be used with other apparatus in which the stroke of a particular component is desirably set to different lengths. Examples of alternative uses for the infinite range limiter include lawn mower height adjustment and chair backrest adjustment. Also, applications where a constant tension is desired, such as tie down straps for cargo transport or sailing equipment or string of musical instruments, are also contemplated for the automatic tensioning capability.

Those skilled in this art will appreciate that the tensioning capability of the hip-and-back machine 20 can be included in other exercise machines that lack a range limiting device. For example, the weight belt 66 can be connected to a clutch pulley mounted within a hub similar to that described hereinabove that is biased by a coiled power spring in the direction needed to take up the weight belt. The hub would be releasable for rotation relative to the frame by a shoulder pin or other releasing device, and its one-way clutch mechanism would permit rotation of the clutch pulley to take up the weight belt but would prevent rotation to let out the belt. Upon release of the shouldered pin, the hub would be free to rotate within its frame. Extension of the pin into a circumferential recess of the hub fixes the hub into place. The clutch pulley or other rotary member is then rotated within the hub by the power spring to take up the weight belt until a desired tension in the belt is reached.

The foregoing is illustrative of the present invention and is not to be construed as limiting thereof. Although a few exemplary embodiments of this invention have been described, those skilled in the art will readily appreciate that many modifications of the exemplary embodiments are possible without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An exercise machine, comprising:

a frame;

a pivotable exercise arm mounted to said frame, configured to engage an exercising user, and moveable along a stroke path having a fully extended position and a fully flexed position;

movement-resisting means for resisting movement of the exercise arm along the stroke path;

interconnecting means for interconnecting the exercise arm and the movement-resisting means so that movement of said exercise arm causes a portion of the movement-resisting means to move in response thereto; and range-limiting means for limiting the distance said exercise arm moves along said stroke path during exercise, said range-limiting means being connected to said interconnecting means and configured to enable a user of the exercise machine to select a first partially flexed position at any desired location along the stroke path such that said exercise arm moves between said first partially flexed position and said fully extended position during exercise;

said range limiting means being configured such that movement of the exercise arm away from the fully extended position past the first partially flexed position by the user selects a second partially flexed position such that said exercise arm moves between said second partially flexed position and said fully extended position during exercise and thereby sets a new distance said exercise arm moves along said stroke path during exercise.

2. The exercise machine defined in claim 1, wherein said interconnecting means includes a flexible member interconnecting said movement-resisting means and said range-limiting means.

3. The exercise machine defined in claim 1, wherein said movement-resisting means comprises a plurality of vertically stacked weights, and wherein movement of said exercise arm from a flexed position to the extended position raises a preselected portion of said plurality of weights.

4. The exercise machine defined in claim 3, wherein said interconnecting means includes a connecting rod and means for interconnecting a selected number of weights in said stack of weights to be interconnected with said connecting rod such that movement of said exercise arm causes said selected number of weights to move in response thereto.

5. An exercise machine, comprising:

a frame;

a pivotable exercise arm mounted to said frame, configured to engage an exercising user, and moveable along a stroke path having a fully extended position and a fully flexed position;

movement-resisting means for resisting movement of the exercise arm along the stroke path;

interconnecting means for interconnecting the exercise arm and the movement-resisting means so that movement of said exercise arm causes a portion of the movement-resisting means to move in response thereto; and range-limiting means for limiting the distance said exercise arm moves along said stroke path during exercise;

said interconnecting means includes a flexible member interconnecting said movement-resisting means and said range-limiting means;

said range-limiting means being connected to said interconnecting means and configured to enable a user of the exercise machine to select a first partially flexed position at any desired location along the stroke path such that said exercise arm moves between said first partially flexed position and said fully extended position during exercise, said range-limiting means comprising a rotary member positioned within a one-way clutch unit mounted on said frame, said rotary member being connected to one end of said flexible member of said interconnecting means, and said one way clutch unit preventing rotation of said rotary member within and relative to said one way clutch unit in a rotative direction such that said rotary member takes up said flexible member and allowing rotation in a rotative direction such that said rotary member lets out said flexible member;

said range limiting means being configured such that movement of the exercise arm away from the fully extended position past the first partially flexed position by the user selects a second partially flexed position such that said exercise arm moves between said second partially flexed position and said fully extended position during exercise.

6. The exercise machine defined in claim 5, wherein said range limiting means further comprises a tensioning unit connected between said rotary member and said exercise arm that maintains tension therebetween as said exercise arm moves between the flexed and extended positions.

7. The exercise machine defined in claim 6, wherein said exercise arm is connected to and coupled for movement with an eccentric cam, wherein said eccentric cam is connected with said tensioning unit, and wherein said tensioning unit is connected between said eccentric cam and said rotary member, and said tensioning unit is configured so that tension is maintained between said rotary member and said cam as said exercise arm moves between the flexed and extended positions during exercise.

8. The exercise machine defined in claim 7, wherein said tensioning unit includes a linear spring positioned between said eccentric cam and said rotary member, and wherein said linear spring is stretched beyond its free length when said exercise arm is in the flexed position.

9. The exercise machine defined in claim 5, wherein said tensioning unit is configured to induce between about 3 and 20 pounds of tension in said flexible member.

10. The exercise machine defined in claim 7, wherein said range limiting means is configured such that, at any position of said exercise arm along said stroke path, said eccentric cam has the same angular orientation relative to said frame irrespective of the location of the first or second partially flexed positions along the stroke path.

11. The exercise machine defined in claim 8, wherein said range limiting means further comprises a pinion attached to and rotatable with said rotary member and a drive gear that engages said pinion, said drive gear being connected with said linear spring.

12. An exercise machine, comprising:

a frame;

a pivotable exercise arm mounted to said frame, configured to engage an exercising user, and moveable along a stroke path having a fully extended position and a fully flexed position;

movement-resisting means for resisting movement of the exercise arm along the stroke path;

interconnecting means for interconnecting the exercise arm and the movement-resisting means so that movement of said exercise arm causes a portion of the movement-resisting means to move in response thereto, said interconnecting means including a flexible member interposed between said exercise arm and said movement-resisting means;

range-limiting means for limiting the distance said exercise arm moves along said stroke path during exercise, said range-limiting means being connected to said interconnecting means and configured to enable a user of the exercise machine to select a first partially flexed position at any desired location along the stroke path such that said exercise arm moves between said first partially flexed position and said fully extended position during exercise; and tensioning means for maintaining tension in said flexible member when said exercise arm is in a flexed position and when said exercise arm is in the extended position, said tensioning means being interconnected with said interconnecting means;

said range limiting means being configured such that movement of the exercise arm away from the fully extended position past the first partially flexed position by the user selects a second partially flexed position such that said exercise arm moves between said second partially flexed position and said fully extended position during exercise.

13. The exercise machine defined in claim 12, wherein said flexible member interconnects said movement-resistant means and said range-limiting means.

14. The exercise machine defined in claim 13, wherein said movement-resisting means comprises a plurality of vertically stacked weights, and wherein movement of said exercise arm from a flexed position to the fully extended position raises a preselected portion of said plurality of weights.

15. The exercise machine defined in claim 14, wherein said interconnecting means includes a connecting rod and means for interconnecting a selected number of weights in said stack of weights with said connecting rod such that movement of said exercise arm causes said selected number of weights to move in response thereto.

16. An exercise machine, comprising:

a frame;

a pivotable exercise arm mounted to said frame, configured to engage an exercising user, and moveable along a stroke path having a fully extended position and a fully flexed position;

movement-resisting means for resisting movement of the exercise arm along the stroke path;

interconnecting means for interconnecting the exercise arm and the movement-resisting means so that movement of said exercise arm causes a portion of the movement-resisting means to move in response thereto, said interconnecting means including a flexible member interposed between said exercise arm and said movement-resisting means;

range-limiting means for limiting the distance said exercise arm moves along said stroke path during exercise comprising a rotary member positioned within a one-way clutch unit mounted on said frame, said rotary member being connected to one end of said flexible member of said interconnecting means, and said one way clutch unit preventing rotation of said rotary member within and relative to said one way clutch unit in a rotative direction such that said rotary member takes up said flexible member and allowing rotation in a rotative direction such that said rotary member lets out said flexible member, said range-limiting means being connected to said interconnecting means and configured to enable a user of the exercise machine to select a first partially flexed position at any desired location along the stroke path such that said exercise arm moves between said first partially flexed position and said fully extended position during exercise; and tensioning means for maintaining tension in said flexible member when said exercise arm is in a flexed position and when said exercise arm is in the extended position, said tensioning means being interconnected with said interconnecting means;

said range limiting means being configured such that movement of the exercise arm away from the fully extended position past the first partially flexed position by the user selects a second partially flexed position such that said exercise arm moves between said second partially flexed position and said fully extended position during exercise.

17. The exercise machine defined in claim 16, wherein said exercise arm is connected to and coupled for movement with an eccentric cam, wherein said eccentric cam is connected with said tensioning unit, and wherein said tensioning unit is connected between said eccentric cam and said rotary member, and said tensioning unit is configured so that tension is maintained between said rotary member and said cam as said exercise arm moves between the flexed and extended positions during exercise.

18. The exercise machine defined in claim 17, wherein said tensioning unit includes a linear spring positioned between said eccentric cam and said rotary member, and wherein said linear spring is stretched beyond its fee length when said exercise arm is in the flexed position.

19. The exercise machine defined in claim 16, wherein said tensioning unit is configured to induce between about 3 and 20 pounds of tension in said flexible member.

20. The exercise machine defined in claim 17, wherein said range limiting means is configured such that, at any position of said exercise arm along, said eccentric cam has the same angular orientation relative to said frame irrespective of the location of the flexed positions along the stroke path.

21. The exercise machine defined in claim 18, wherein said range limiting means further comprises a pinion attached to and rotatable with said rotary member and a drive gear that engages said pinion, said drive gear being connected with said linear spring.

* * * * *

UNITED STATES PATENT AND TRADEMARK OFFICE

CERTIFICATE OF CORRECTION

PATENT NO. : 7,083,554 B1
APPLICATION NO. : 08/807372
DATED : August 1, 2006
INVENTOR(S) : Michael A. LoPresti It is certified that error appears in the above-identified patent and that said Letters Patent is hereby corrected as shown below:

Title page, Item (56), References Cited, FOREIGN PATENT DOCUMENTS, delete the following:

WO 96/1455 A1 09/1996

Title page, Item (56), References Cited, FOREIGN PATENT DOCUMENTS, insert the following:

WO 96/26765 A1 09/1996

Signed and Sealed this

Thirty-first Day of October, 2006

JON W. DUDAS
*Director of the United States Patent and Trademark Office*